US011986094B2

(12) United States Patent
Bisman et al.

(10) Patent No.: US 11,986,094 B2
(45) Date of Patent: May 21, 2024

(54) ARM ASSEMBLY FOR A CHAIR

(71) Applicant: FORMWAY FURNITURE LIMITED, Wellington (NZ)

(72) Inventors: Christopher Warren Bisman, Martinborough (NZ); James Clifford Prier, Wellington (NZ); Fabian David Haarbeck, Wellington (NZ); Paul Michael Wilkinson, Wellington (NZ); Damon Gregory Burwell, Wellington (NZ); Hugh Thomas Mccoshim, Greytown (NZ); Leon Harley Craze, Lower Hutt (NZ); Rachael Jessica Hall, Wellington (NZ)

(73) Assignee: Formway Furniture Limited, Wellington (NZ)

( * ) Notice: Subject to any disclaimer, the term of this patent is extended or adjusted under 35 U.S.C. 154(b) by 0 days.

(21) Appl. No.: 18/006,241

(22) PCT Filed: Jul. 21, 2021

(86) PCT No.: PCT/IB2021/056568
§ 371 (c)(1),
(2) Date: Jan. 20, 2023

(87) PCT Pub. No.: WO2022/018645
PCT Pub. Date: Jan. 27, 2022

(65) Prior Publication Data

US 2023/0309696 A1 Oct. 5, 2023

(30) Foreign Application Priority Data

Jul. 22, 2020 (NZ) ..... 766466

(51) Int. Cl.
*A47C 7/54* (2006.01)
*A47C 1/03* (2006.01)

(52) U.S. Cl.
CPC ..... *A47C 1/0305* (2018.08); *A47C 1/0307* (2018.08); *A47C 1/0308* (2018.08); *A47C 7/541* (2018.08)

(58) Field of Classification Search
CPC ..... A47C 1/0308; A47C 7/541
(Continued)

(56) References Cited

U.S. PATENT DOCUMENTS 3,829,159 A * 8/1974 Leffler ..... A47C 7/543 297/411.31
5,620,233 A * 4/1997 Corwin ..... A47C 7/402 297/411.36

(Continued)

FOREIGN PATENT DOCUMENTS

EP 0317835 A1 * 5/1989 ..... A47C 1/0308
KR 101974037 B1 5/2019

OTHER PUBLICATIONS

International Preliminary Report on Patentability dated Apr. 11, 2022, issued in PCT Application No. PCT/IB2021/056568, filed Jul. 21, 2021.

*Primary Examiner* — Rodney B White
(74) *Attorney, Agent, or Firm* — Workman Nydegger

(57) ABSTRACT

An arm assembly for a chair having a post, a first member, and an armrest. The first member is angularly adjustable relative to the post about a first axis between first angular movement limits, with a non-finite number of angular adjustment positions of the first member relative to the post. The armrest is operatively connected to the first member to translationally slide generally forward and rearward relative to the first member between first translational movement limits, with a non-finite number of translational adjustment positions of the armrest relative to the first member. The armrest is angularly adjustable relative to the first member about a second substantially upright axis between second (Continued)

angular movement limits, with a non-finite number of angular adjustment positions of the armrest relative to the first member.

20 Claims, 33 Drawing Sheets

(58) Field of Classification Search
USPC ..... 297/411.2–411.41
See application file for complete search history.

(56) References Cited

U.S. PATENT DOCUMENTS 5,660,442 A 8/1997 Tornero
5,839,786 A * 11/1998 Cvek ..... A47C 1/03 297/411.36
6,059,366 A * 5/2000 Hu ..... B60N 2/75 297/411.31
6,074,012 A * 6/2000 Wu ..... A47C 1/03 297/411.31
6,076,891 A * 6/2000 Bernhardt ..... A47C 7/541 297/411.31
6,168,237 B1 * 1/2001 Lamart ..... A47C 1/03 297/411.35 X
6,203,109 B1 3/2001 Bergsten et al.
6,290,300 B1 9/2001 Sutton et al.
6,554,364 B1 4/2003 Dammermann et al.
6,619,746 B2 * 9/2003 Roslund, Jr. ..... A47C 1/03 297/411.31
6,877,813 B2 4/2005 Caruso et al.
7,011,371 B1 * 3/2006 Tsai ..... A47C 1/0305 297/411.36
7,150,504 B1 * 12/2006 Lee ..... A47C 1/0307 297/411.35
7,201,450 B1 * 4/2007 Chen ..... A47C 1/0308 297/411.37
7,207,629 B2 * 4/2007 Goetz ..... A47C 7/68 297/411.31 X
7,246,859 B2 * 7/2007 Igarashi ..... A47C 1/03 297/411.36
7,380,886 B1 * 6/2008 Copello ..... A47C 7/54 297/411.31
7,490,910 B1 * 2/2009 Draughon ..... A47C 1/0308 297/411.31
7,837,269 B2 * 11/2010 Bock ..... A47C 1/03 297/411.36
7,862,123 B2 * 1/2011 Baker ..... A47C 7/543 297/411.31 X
8,246,117 B2 8/2012 Melhuish et al.
9,132,755 B2 9/2015 Rosenbrock et al.
9,603,451 B2 3/2017 Masunaga et al.
10,537,176 B2 1/2020 Bock
2004/0227388 A1 * 11/2004 Wang ..... A47C 1/03 297/411.35
2008/0084103 A1 * 4/2008 Bock ..... A47C 1/0308 297/411.35
2008/0191537 A1 * 8/2008 Oda ..... A47C 1/03 297/411.36
2009/0302661 A1 * 12/2009 Melhuish ..... A47C 1/0307 297/411.35 X
2011/0074188 A1 * 3/2011 Freer ..... B60N 2/753 297/411.31
2011/0095587 A1 * 4/2011 Baker ..... A47C 7/54 297/354.1
2015/0130250 A1 5/2015 Masunaga et al.
2015/0298587 A1 * 10/2015 Machael ..... B60N 2/78 297/411.38 X
2016/0316917 A1 11/2016 Qu et al.
2018/0279787 A1 * 10/2018 Serena ..... A47C 1/03
2019/0030725 A1 1/2019 Olander et al.
2019/0365108 A1 12/2019 Deevers et al.
2021/0219729 A1 * 7/2021 Bock ..... A47C 7/541

* cited by examiner

ARM ASSEMBLY FOR A CHAIR

This application claims priority from New Zealand patent application 766466 filed on 22 Jul. 2020, the entire content of which is incorporated herein by way of reference.

FIELD OF THE INVENTION

This invention relates to an arm assembly for a chair.

BACKGROUND

Chairs with fixed arms are known in the art and typically do not provide sufficient adjustability to suit a range of body sizes, types, and sitting preferences of a user of the chair. Adjustable arm assemblies that have been developed to do so typically provide adjustability in various directions. However, an increase in adjustability usually results in more complex and bulky internal mechanisms.

Adjustable armrests also often require an actuator to be released to adjust the armrest, making them complex to adjust. Some adjustable armrests have indexed or discretised adjustment positions which result in a harsh, clunky or awkward adjustment action.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is an object of at least preferred embodiments of the present invention to provide an arm assembly comprising an armrest that is substantially freely adjustable in the width and depth directions between movement limits. It is an additional or alternative object of at least preferred embodiments of the present invention to at least provide the public with a useful alternative.

SUMMARY OF THE INVENTION

In a first aspect of the invention, there is provided an arm assembly for a chair, the arm assembly comprising: a post for mounting to the chair; a first member that is operatively connected to the post, wherein the first member is angularly adjustable relative to the post about a first substantially upright axis between first angular movement limits, the arm assembly comprising a non-finite number of angular adjustment positions of the first member relative to the post between the first angular movement limits; and an armrest that is operatively connected to the first member to translationally slide generally forward and rearward relative to the first member between first translational movement limits, the arm assembly comprising a non-finite number of translational adjustment positions of the armrest relative to the first member between the first translational movement limits, and wherein the armrest is angularly adjustable relative to the first member about a second substantially upright axis between second angular movement limits, the arm assembly comprising a non-finite number of angular adjustment positions of the armrest relative to the first member between the second angular movement limits.

In an embodiment, an inward angular adjustment of the first member relative to the post and an outward angular adjustment of a front end of the armrest relative to the first member together provide a lateral inward width adjustment of the armrest.

In an embodiment, an outward angular adjustment of the first member relative to the post and an inward angular adjustment of a front end of the armrest relative to the first member together provide a lateral outward width adjustment of the armrest.

In an embodiment, the post comprises a substantially upright inner post member and the first member comprises an outer housing that is slidably mounted on and receives the inner post member in a telescopic arrangement.

In an embodiment, the outer housing is angularly adjustable relative to the inner post member about the first substantially upright axis between the first angular movement limits.

In an embodiment, the first member comprises an upper angle stop positioned at the second substantially upright axis.

In an embodiment, the armrest comprises a slide plate, the slide plate comprising a slot for receiving the upper angle stop.

In an embodiment, the arm assembly comprises a first frictional arrangement associated with the upper angle stop, wherein the first frictional arrangement is configured to provide a first frictional force that must be overcome by a user to translationally slide and angularly adjust the armrest relative to the first member.

In an embodiment, the first frictional arrangement comprises a biasing device to bias the slide plate into contact with the upper angle stop to provide the first frictional force.

In an embodiment, the arm assembly comprises an adjuster to adjust the first frictional force provided by the first frictional arrangement.

In an embodiment, a front edge and a rear edge of the slot and a front edge and a rear edge of the upper angle stop are configured to define the first translational movement limits, such that the armrest can translationally slide in a generally forward direction relative to the first member until the rear edge of the slot contacts the rear edge of the upper angle stop and such that that the armrest can translationally slide in a generally rearward direction relative to the first member until the front edge of the slot contacts the front edge of the upper angle stop.

In an embodiment, the rear edge of the upper angle stop contacting the rear edge of the slot defines a frontmost translational position of the armrest relative to the first member and wherein the front edge of the upper angle stop contacting the front edge of the slot defines a rearmost translational position of the armrest relative to the first member.

In an embodiment, the slot is configured such that the armrest moves laterally when being moved generally forwardly and rearwardly over at least part of the movement of the armrest.

In an embodiment, a rear portion of a path of the slot is non-linear such that the armrest translationally sliding in a generally forward direction relative to the first member from the rearmost translational position causes an outward lateral movement of the armrest relative to the first member, and the armrest translationally sliding in a generally rearward direction relative to the first member toward the rearmost translational position causes an inward lateral movement of the armrest relative to the first member.

In an embodiment, a periphery of the upper angle stop and side walls of the slot are configured to define the second angular movement limits.

In an embodiment, the periphery of the upper angle stop comprises: an outer side having a forward wall portion and a rear wall portion that are oriented at an angle of more than 90 degrees and less than 180 degrees relative to each other; and an inner side having a forward wall portion and a rear wall portion that are oriented at an angle of more than 90 degrees and less than 180 degrees relative to each other, wherein the forward wall portion of the outer side is substantially parallel to the rear wall portion of the inner side, and wherein the rear wall portion of the outer side is substantially parallel to the forward wall portion of the inner side.

In an embodiment, the forward wall portion of the outer side is configured to engage with an outer side wall of the slot and the rear wall portion of the inner side is configured to engage with an inner side wall of the slot, to define an inward angular adjustment limit of the second angular movement limits; and the rear wall portion of the outer side is configured to engage with an outer side wall of the slot and the forward wall portion of the inner side is configured to engage with an inner side wall of the slot, to define an outward angular adjustment limit of the second angular movement limits.

In an embodiment, the periphery of the upper angle stop is configured such that the maximum outward angular adjustment of the front end of the armrest relative to the first member is about 21 degrees from a neutral position of the armrest relative to the first member.

In an embodiment, the periphery of the upper angle stop is configured such that the maximum inward angular adjustment of the front end of the armrest relative to the first member is about 10 degrees from the neutral position of the armrest relative to the first member.

In an embodiment, the arm assembly comprises a second frictional arrangement that is configured to provide a second frictional force that must be overcome by a user to angularly adjust the first member relative to the post.

In an embodiment, the second frictional arrangement comprises a biasing device to bias a portion of the first member into contact with the post to provide the second frictional force.

In an embodiment, a component keyed to the first member and mounted to the post comprises a lower angle stop positioned at the first substantially upright axis, wherein the lower angle stop is configured to define the first angular movement limits.

In an embodiment, the component keyed to the first member and mounted to the post comprises a lock housing, and wherein a lower angle stop is provided by a portion of the lock housing that is engageable with complementary engagement surfaces on the inner post member to define the first angular movement limits.

In an embodiment, the lower angle stop is configured such that a maximum outward angular adjustment of the first member relative to the post is about 10 degrees from a neutral position of the first member relative to the post.

In an embodiment, the lower angle stop is configured such that the maximum inward angular adjustment of the first member relative to the post is about 45 degrees from the neutral position of the first member relative to the post.

In an embodiment, the outer housing slidably receives the post in a telescopic arrangement such that the height of the first member is adjustable relative to the post.

In an embodiment, the outer housing comprises a plurality of recesses disposed within an interior of the outer housing and provided along a length thereof; the inner post member comprises a locking member biased to engage with one of the plurality of recesses of the outer housing to lock the position of the outer housing relative to the inner post member; and the outer housing comprises a release member in operable connection with an actuator and having a plurality of recesses with raised surfaces therebetween, wherein the release member is slidably moveable relative to the outer housing between a first position in which at least one of the recesses in the release member is aligned with at least one of the recesses of the outer housing and the locking member engages at least one of the recesses in the outer housing to inhibit telescopic movement of the outer housing relative to the inner post member, and a second position in which one or more of the raised surfaces of the release member aligns with the one or more recesses of the outer housing to remove the locking member from engagement with the recess or recesses and to provide a surface over which the locking member can slide to enable relative movement between the outer housing and the inner post member.

In an embodiment, the arm assembly comprises a lock housing that carries the locking member, the lock housing being rotatably mounted to the inner post member and keyed to the outer housing to inhibit relative rotation between the lock housing and the outer housing such that upon an angular adjustment of the first member relative to the post, the lock housing undergoes a corresponding angular adjustment relative to the post.

In an embodiment, the arm assembly comprises a damping arrangement between the outer housing and the inner post member, the damping arrangement configured to inhibit lateral movement of the first member relative to the post.

In an embodiment, the damping arrangement comprises at least one first biasing member extending between the lock housing and an internal wall of the outer housing and at least one second biasing member extending between the inner post member and the internal wall of the outer housing, the at least one first biasing member and the at least one second biasing member being spaced apart in a vertical direction.

In an embodiment, the damping arrangement comprises at least one first biasing member extending between the lock housing and an internal wall of the outer housing, and comprises at least one rib extending between the inner post member and the internal wall of the outer housing, the at least one first biasing member and the at least one rib being spaced apart in a vertical direction.

In an embodiment, the at least one first biasing member is integrally formed with the lock housing.

In a second aspect of the invention, there is provided a chair comprising two of the arm assemblies as outlined in relation to the first aspect above.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This invention may also be said broadly to consist in the parts, elements and features referred to or indicated in the specification of the application, individually or collectively, and any or all combinations of any two or more said parts, elements or features.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term '(5)' following a noun means the plural and/or singular form of that noun.

As used herein the term 'and/or' means 'and' or 'or', or where the context allows both. The invention consists in the foregoing and also envisages constructions of which the following gives examples only.

BRIEF DESCRIPTION OF THE DRAWINGS

The present invention will now be described by way of example only and with reference to the accompanying drawings in which.

DETAILED DESCRIPTION OF A PREFERRED EMBODIMENT

Figure 1:
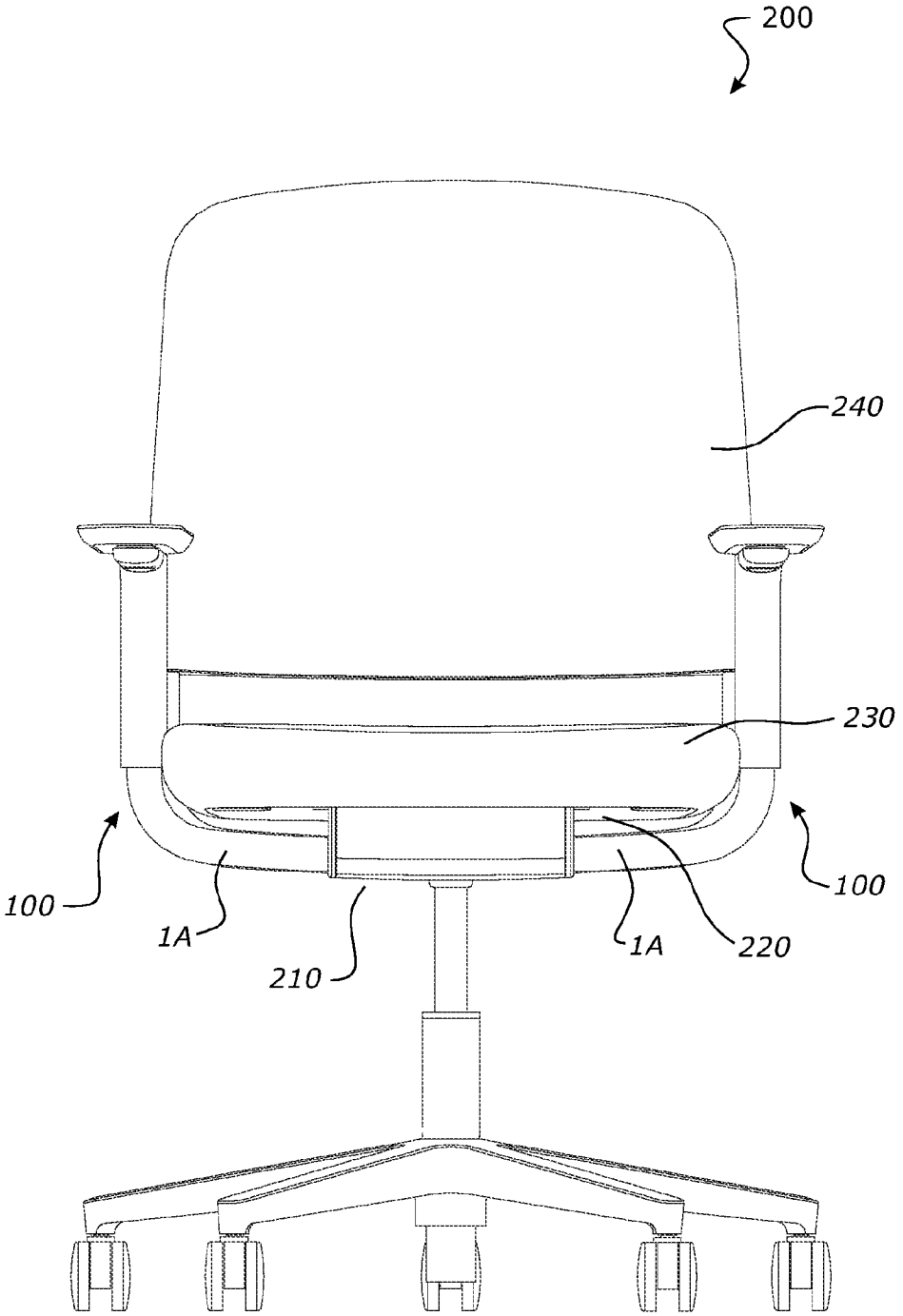
FIG. 1 shows a front view of a chair having an arm assembly.

FIG. 1 shows an arm assembly 100 for a chair 200 provided on both sides of the chair 200. The chair 200 shown is a task chair but may be another type of chair as outlined below.

Figure 2:
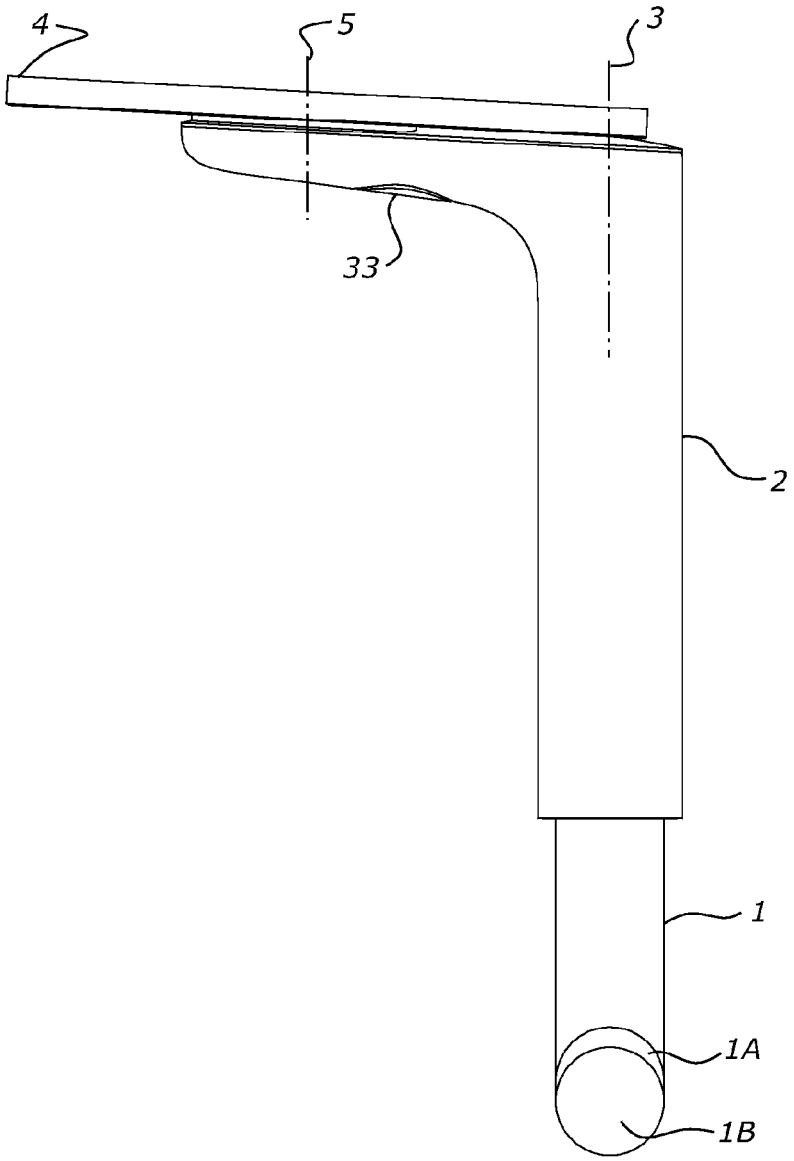
FIG. 2 shows a side view of the arm assembly.

FIG. 2 shows a detailed view of the arm assembly 100. The arm assembly 100 comprises a post 1 for mounting to the chair and a first member 2 that is operatively connected to the post 1. The first member 2 is angularly adjustable relative to the post 1 about a first substantially upright axis 3 between first angular movement limits, the arm assembly 100 comprising a non-finite number of angular adjustment positions of the first member 2 relative to the post 1 between the first angular movement limits. The non-finite number of angular adjustment positions allows the first member 2 to be freely angularly adjustable relative to the post 1 about the first substantially upright axis 3, such that the movement therein is smooth, indiscrete and non-indexed between said first angular movement limits.

FIG. 2 also shows an armrest 4 that is operatively connected to the first member 2 to translationally slide generally forward and rearward relative to the first member 2 between first translational movement limits, the arm assembly 100 comprising a non-finite number of translational adjustment positions of the armrest 4 relative to the first member 2 between the first translational movement limits. The non-finite number of translational adjustment positions allows the armrest 4 to be freely translationally adjustable relative to the first member 2, such that the movement therein is smooth, indiscrete and non-indexed between said first translational movement limits.

The armrest 4 shown has an armrest slide plate 16 described below in relation to FIG. 8, however the armrest 4 will typically be an assembly of the slide plate 16 and a cushion or other support surface. The cushion is shown in FIG. 1 but not in the other figures so that movement features of the arm assembly 100 can be clearly seen.

The armrest 4 is also angularly adjustable relative to the first member 2 about a second substantially upright axis 5 between second angular movement limits, the arm assembly 100 comprising a non-finite number of angular adjustment positions of the armrest 4 relative to the first member 2 between the second angular movement limits. The non-finite number of angular adjustment positions allows the armrest 4 to be freely angularly adjustable relative to the first member 2 about the second substantially upright axis 5, such that the movement therein is smooth, indiscrete and non-indexed between said second angular movement limits.

The non-finite number of angular adjustment positions and non-finite number of translational adjustment positions described herein can be considered to be an indeterminable and/or infinite number of adjustment positions.

The transition from one adjustment position to the next is smooth, indiscrete, and/or non-indexed within each of the above described movement limits.

FIGS. 3-13 show the arm assembly 100 in some of its various adjustment positions; however, the exemplary features or components that provide the functionality of the arm assembly 100 are described in more detail below with reference to FIGS. 14-21.

Figure 3:
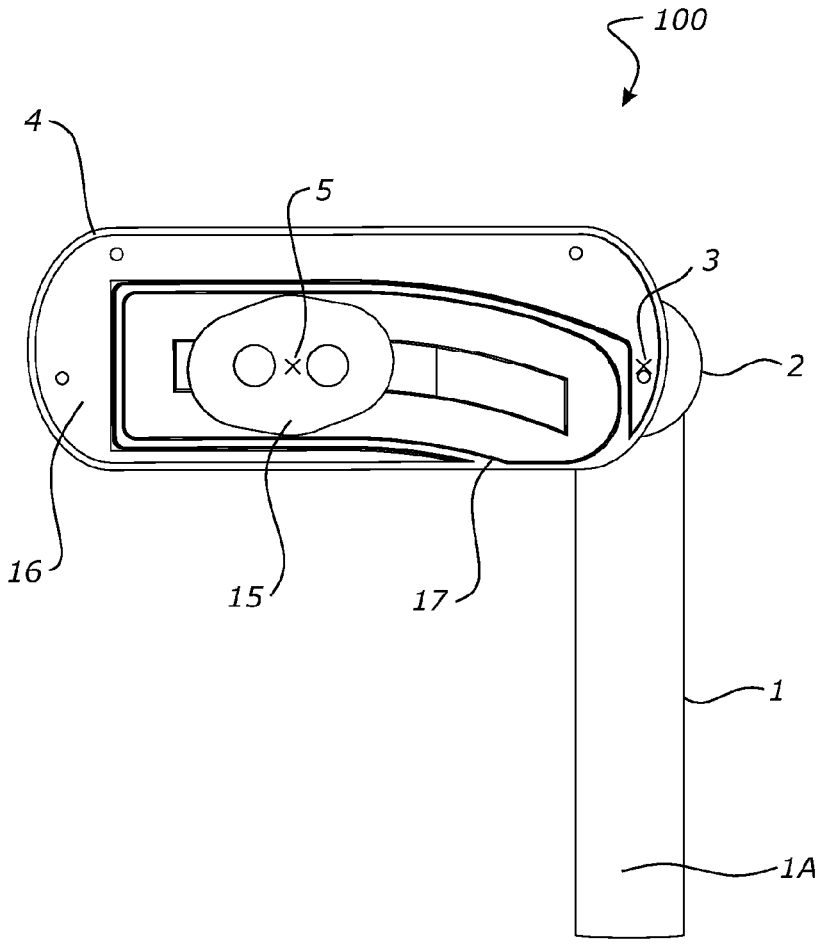
FIG. 3 shows a plan view of the arm assembly in its default position.

FIG. 3 shows a 'top-down', or plan view of the arm assembly 100 in its default position. The first member 2 is shown in a neutral position relative to the post 1, in that the angular position of the first member 2 about the first substantially upright axis 3 has not been changed and thus the angular position of the first member 2 relative to the post 1 is 0 degrees. Likewise, the armrest 4 is shown in a neutral position relative to the first member 2, in that the angular position of the armrest 4 about the second substantially upright axis 5 has not been changed and thus the angular position of the armrest 4 relative to the first member 2 is 0 degrees.

With reference to FIGS. 1 and 2, the post 1 is also shown having a mounting portion 1A extending laterally inwardly from a lower end of the post 1, with a mounting end 1B for fixture of the post 1 to the chair 200. The mounting end 1B may comprise any suitable arrangement for connecting the post 1 to the chair 200, such as, for example, a flange and fastener arrangement or a clip arrangement. The flange could have any suitable arrangement. For example, and flange could extend any one or more of: upwardly, downwardly, forwardly, or rearwardly from the inner end of the post.

The arm assembly 100 of FIGS. 2-13 and 21 would appropriately be connected to a right-side of the chair 200. The embodiments of all the figures described herein are also shown in this 'right-side' configuration, however, the arrangement would simply need to be mirrored about the vertical plane to suit a 'left-side' configuration. Thus, any description of the functions and features of the arm assembly disclosed herein apply equally to an arm assembly taking a 'left-side' configuration.

FIG. 1 shows the mounting portion 1A connected to a transom 210 of the chair 200; however, the mounting portion 1A may be of any appropriate length, and may connect to any appropriate component of the chair 200 at any angle relative to said component. For example, the mounting portion 1A may connect to an underside 220 of the seat, a different part of the seat 230, or a back 240 of the chair 200.

Further, the terms 'inwardly' and 'outwardly' as used in this specification and claims are to be interpreted as 'inward' relative to the chair 200 and 'outward' relative to the chair 200. Inward movement of any component of the arm assembly 100 described herein brings said component closer to the chair 200, and an outward movement of any component of the arm assembly 100 described herein moves said component further away from the chair 200.

Finally, the position of the first substantially upright axis 3 relative to the second substantially upright axis 5 define a 'front' and 'rear' reference as used in this specification and claims, in that the first substantially upright axis 3 is rearward relative to the second substantially upright axis 5. Similar terms such as 'forward', 'rearward', 'forwardly', 'rearwardly', 'front end/portion' and 'rear end/portion' are to be interpreted in a similar manner. In some embodiments, the first substantially upright axis 3 is offset from the second substantially upright axis 5 in the horizontal plane.

Figure 4:
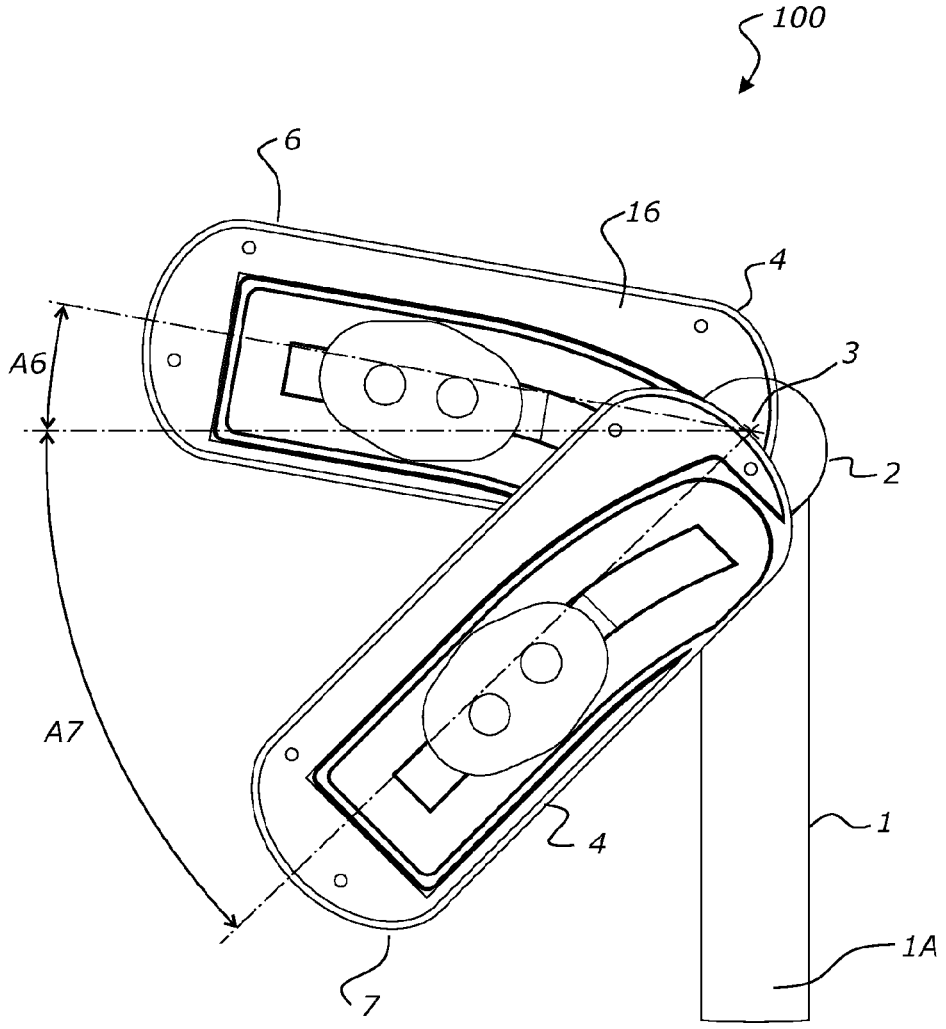
FIG. 4 shows a plan view of the arm assembly and its first angular movement limits.

FIG. 4 shows the arm assembly 100 and its first angular movement limits. In this embodiment, the armrest 4 is shown as remaining in its neutral position relative to the first member 2, whereas the first member 2 is shown at either end of the first angular movement limits of the first member 2 relative to the post 1.

The first member 2 is shown at its maximum outward angular adjustment position 6 relative to the post 1. In this maximum outward angular adjustment position 6, the first member 2 has moved to an angular displacement A6 of about 10 degrees outwardly from a neutral position of the first member 2 relative to the post 1. The first member 2 is also shown at its maximum inward angular adjustment position 7 relative to the post 1. In this maximum inward angular adjustment position 7, the first member 2 has moved to an angular displacement A7 of about 45 degrees inwardly from a neutral position of the first member 2 relative to the post 1.

Figure 5:
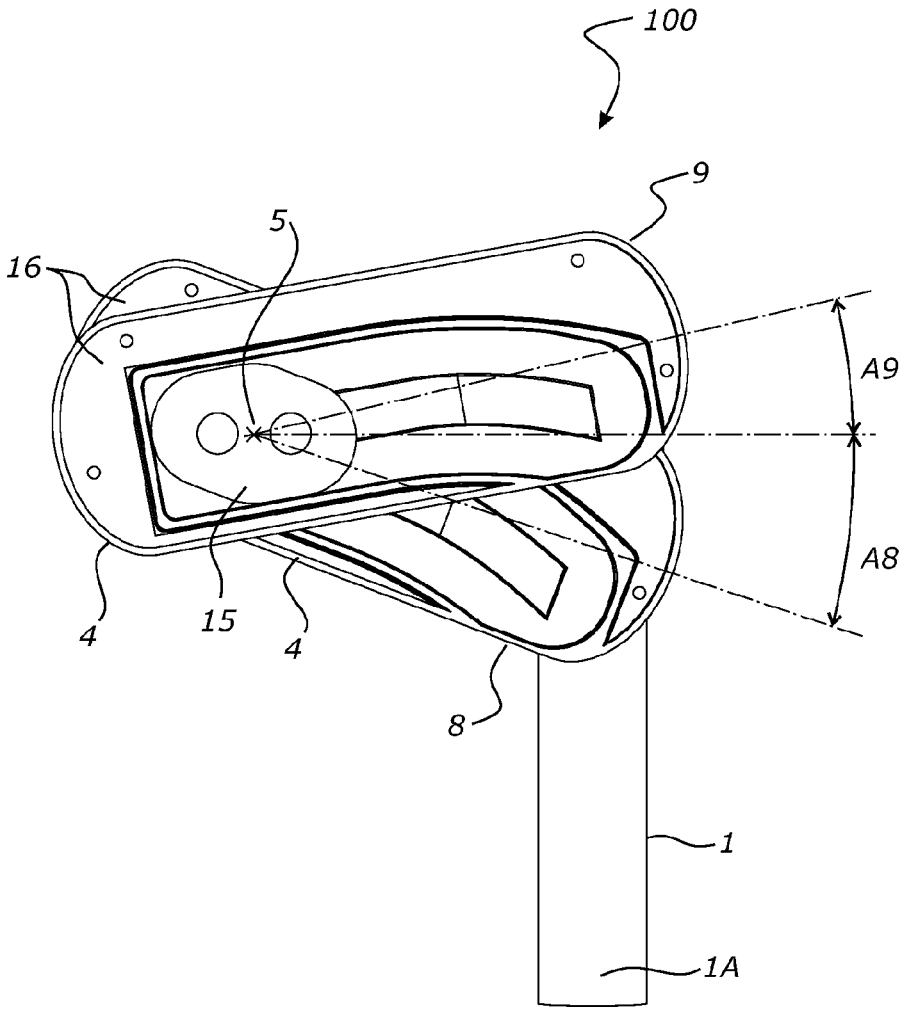
FIG. 5 shows a plan view of the arm assembly and its second angular movement limits.

FIG. 5 shows the arm assembly 100 and its second angular movement limits. In this embodiment, the first member 2 remains in its neutral position relative to the post 1, whereas the armrest 4 is shown at either end of the second angular movement limits of the armrest 4 relative to the first member 2.

The armrest 4 is shown at its maximum outward angular adjustment position 8 relative to the first member 2. In this maximum outward angular adjustment position 8, a front end of the armrest 4 has moved to an angular displacement A8 of about 21 degrees outwardly from a neutral position of the armrest 4 relative to the first member 2. The armrest 4 is also shown at its maximum inward angular adjustment position 9 relative to the first member 2. In this maximum inward angular adjustment position 9, a front end of the armrest 4 has moved to an angular displacement A9 of about 10 degrees inwardly from a neutral position of the armrest 4 relative to the first member 2.

It should be noted that the front end of the armrest 4 is used herein as a reference for the direction of angular movement inwardly or outwardly relative to the chair 200. The entire armrest 4 moves as a unit, and so any movement of a front end of the armrest 4 described herein applies equally to the entire armrest 4.

Figure 6:
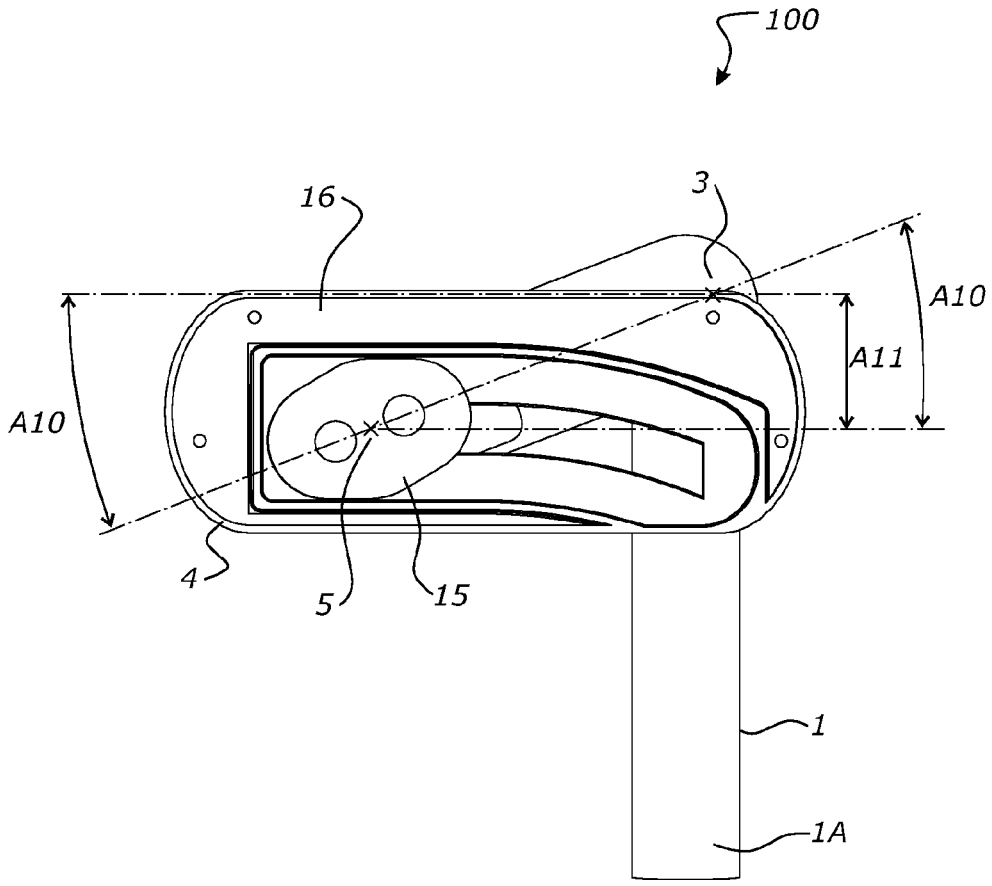
FIG. 6 shows a plan view of the arm assembly and its lateral inward position.
Figure 7:
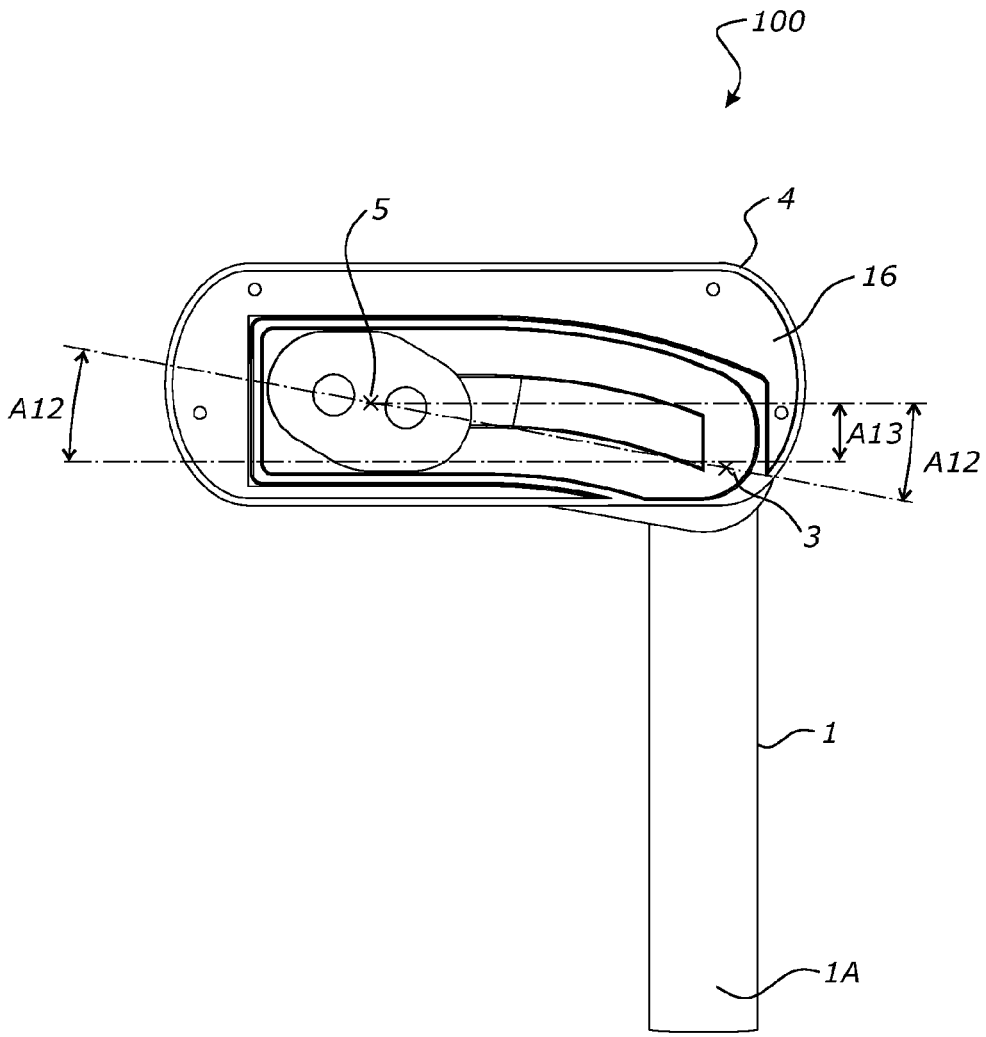
FIG. 7 shows a plan view of the arm assembly and its lateral outward position.

FIGS. 6 and 7 show how a combination of angular adjustment of the first member 2 about the first substantially upright axis 3 and angular adjustment of the armrest 4 about the second substantially upright axis 5 can advantageously provide inward and outward width adjustment of the armrest 4 relative to the chair 200 while keeping the armrest 4 substantially parallel relative to the chair 200. Thus, the distance between armrests provided on both sides of the chair 200 can be adjusted to suit different body sizes, types and seating preferences of a user, while keeping the armrests oriented substantially parallel relative to the chair 200.

In FIG. 6, inward angular adjustment of the first member 2 relative to the post 1 and an outward angular adjustment of a front end of the armrest 4 relative to the first member 2 together provide a lateral inward width adjustment of the armrest 4. In this lateral inward position 10, a front end of the armrest 4 moves to an angular displacement A10 of about 21 degrees outwardly from a neutral position of the armrest 4 relative to the first member 2 and the first member 2 moves to an angular displacement A10 of about 21 degrees inwardly from a neutral position of the first member 2 relative to the post 1. As a result, the armrest 4 has moved about 34 millimetres inwardly from a neutral position of the first member 2 relative to the post 1 and a neutral position of the armrest 4 relative to the first member 2, as indicated by the lateral inward displacement A11.

In FIG. 7, outward angular adjustment of the first member 2 relative to the post 1 and an inward angular adjustment of a front end of the armrest 4 relative to the first member 2 together provide a lateral outward width adjustment of the armrest 4. In this lateral outward position 12, a front end of the armrest 4 moves to an angular displacement A12 of about 10 degrees inwardly from a neutral position of the armrest 4 relative to the first member 2 and the first member 2 moves to an angular displacement A12 of about 10 degrees outwardly from a neutral position of the first member 4 relative to the post 1. As a result, the armrest 4 has moved about 16 millimetres outwardly from a neutral position of the first member 2 relative to the post 1 and a neutral position of the armrest 4 relative to the first member 2, as indicated by the lateral outward displacement A13.

Figure 8:
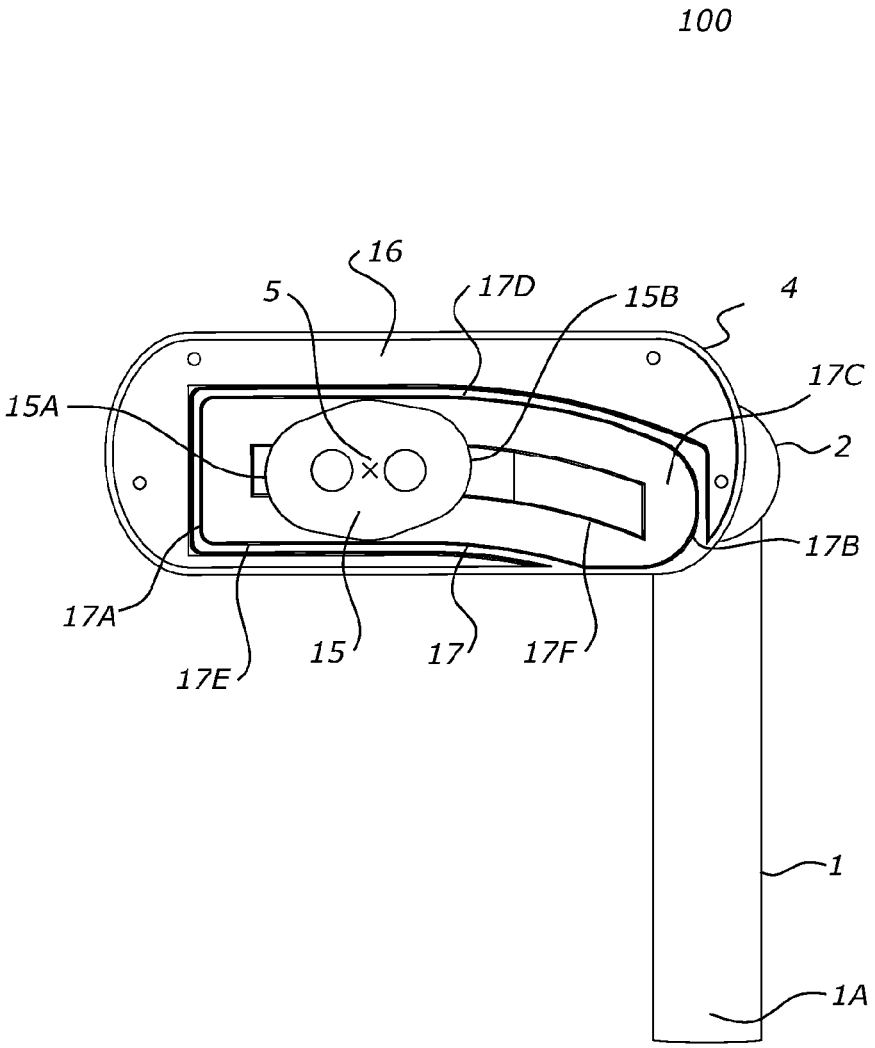
FIG. 8 shows a plan view of the arm assembly and its upper angle stop and slide plate.

As shown in FIG. 8, the first member 2 comprises an upper angle stop 15 positioned at the second substantially upright axis 5 such that a centre of the upper angle stop 15 aligns with the second substantially upright axis 5. The armrest 4 is shown comprising a slide plate 16 having a slot 17 having an upper recess for receiving the upper angle stop 15, the slot 17 also having a lower slit 17F for passage of a portion of the upper angle stop 15 therethrough.

In the form shown, shanks of mounting bolts 44 extend through the slit 17F as described below in relation to FIG. 19.

Figure 12:
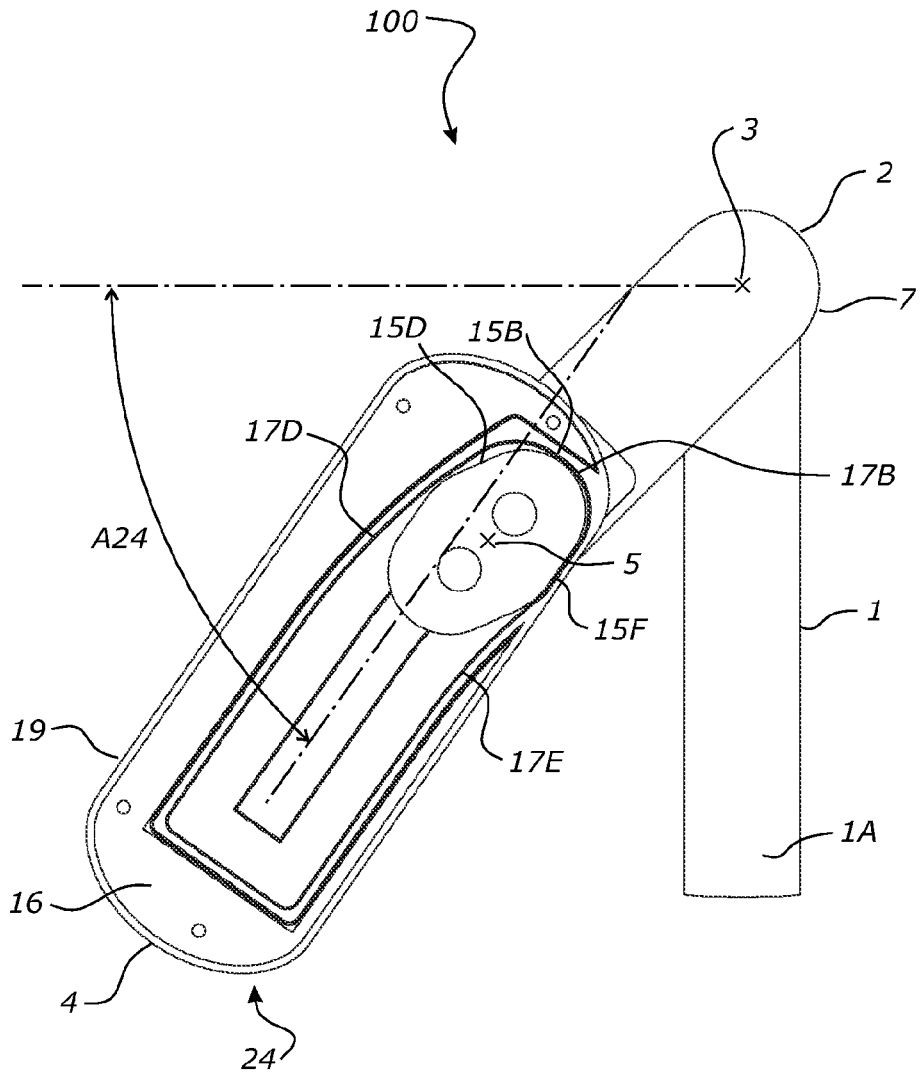
FIG. 12 shows a plan view of the arm assembly and its ultimate inward angular adjustment position.

A front edge 17A and a rear edge 17B of the slot 17 and a front edge 15A and a rear edge 15B of the upper angle stop 15 are configured to define the first translational movement limits, such that the armrest 4 can translationally slide in a generally forward direction relative to the first member 2 until the rear edge of the slot 17B contacts the rear edge of the upper angle stop 15B (e.g. as shown in FIG. 12) and such that that the armrest 4 can translationally slide in a generally rearward direction relative to the first member 2 until the front edge of the slot 17A contacts the front edge of the upper angle stop 15A. The front and rear edges 17A, 17B of the slot 17 and a periphery of the lower slit 17F may be formed by walls, bumps or stops for example.

Figure 9:
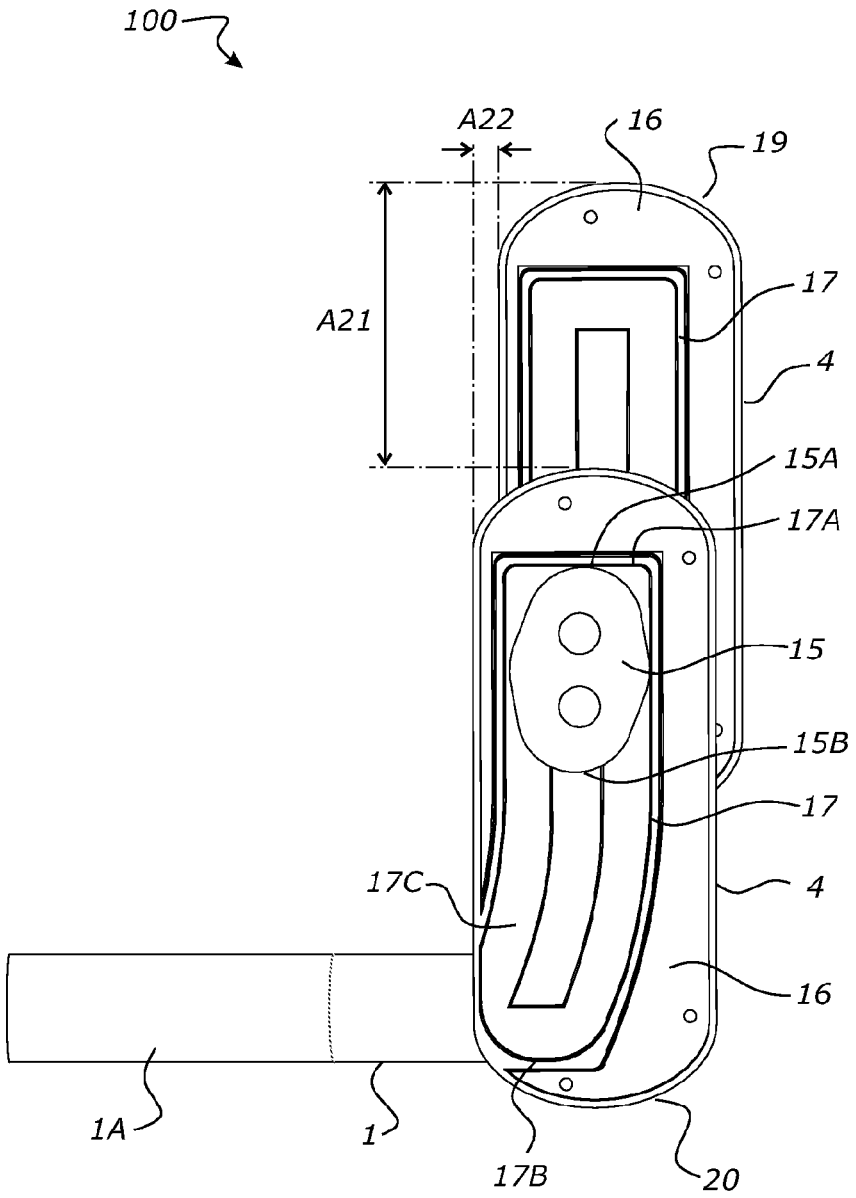
FIG. 9 shows a plan view of the arm assembly and its first translational movement limits.

The first translational movement limits are shown in FIG. 9, in which the rear edge 15B of the upper angle stop 15 contacting the rear edge of the slot 17B defines a frontmost translational position 19 of the armrest 4 relative to the first member 2, and wherein the front edge of the upper angle stop 15A contacting the front edge of the slot 17A defines a rearmost translational position 20 of the armrest 4 relative to the first member 2. The armrest 4 thereby moving about 80 millimetres forwardly or rearwardly when moving from either of the frontmost translation position 19 or the rearmost translation position to the other of the frontmost translation position 19 or the rearmost translation position 20, as indicated by the translational displacement A21.

Figure 10:
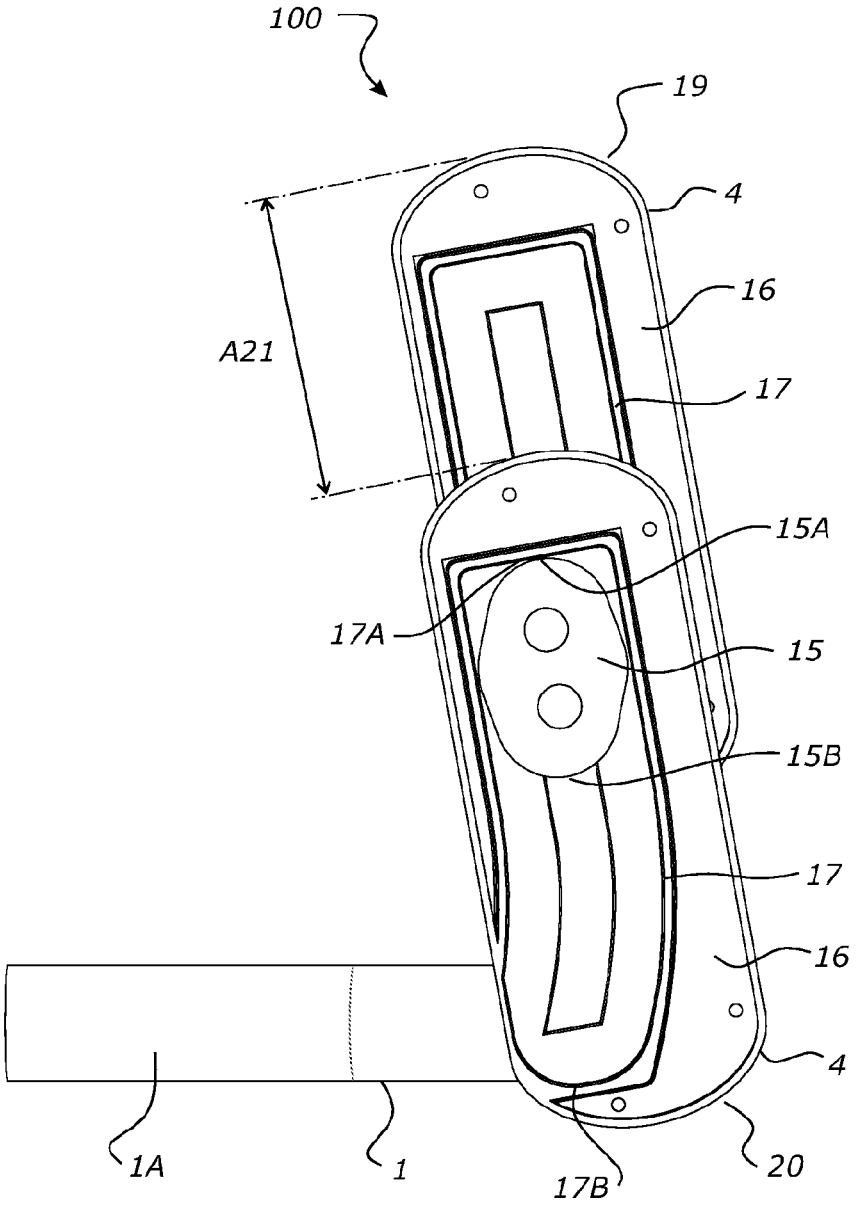
FIG. 10 shows a plan view of the arm assembly and its first translational movement limits.

FIG. 10 shows how the direction of translation of the armrest 4 when the angular position of the armrest 4 relative to the first member 2 is 0 degrees corresponds to the angular position of the first member 2 relative to the post 1. However, it should be noted that if the angular position of the armrest 4 relative to the first member 2 is changed, the translation of the armrest 4 may occur in a direction that corresponds to the angular position of the armrest 4 relative to the first member 2. However, the about 80 millimetres of forward or rearward translation of the armrest 4 as described above remains the same irrespective of the angular position of the armrest 4 relative to the first member 2, as indicated by the translational displacement A21.

In some embodiments, the slot 17 is configured such that the armrest 4 moves laterally when being moved generally forwardly and rearwardly over at least part of the movement of the armrest 4. For instance, a rear portion 17C of the path of the slot 17 may be non-linear, or curved as shown in FIG. 9 such that the armrest 4 translationally sliding in a generally forward direction relative to the first member 2 from the rearmost translational position 20 causes an outward lateral movement of the armrest 4 relative to the first member 2. Thus, the armrest 4 translationally sliding in a generally rearward direction relative to the first member 2 toward the rearmost translational position 20 causes an inward lateral movement of the armrest 4 relative to the first member 2.

This can be seen in FIG. 9, where the lateral position of the armrest 4 is further outward in the frontmost translational position 19 than it is in the rearmost translational position 20. The armrest 4 moving to the frontmost translational position 19 from the rearmost translational position 20 thereby moving about 7 millimetres outwardly from the rearmost translational position 20 of the armrest 4, as indicated by the lateral translational displacement A22.

Alternatively, the path of the slot 17 may take any other shape or curvature so as to cause the armrest 4 to move laterally when being moved generally forwardly and rearwardly over at least part of the translational movement of the armrest 4. Thus, the path of the slot 17 can be configured to result in any desired inward or outward lateral movement of the armrest 4 during a translation movement of the armrest 4 relative to the first member 2, for instance, to suit different seating preferences of a user.

In some embodiments, the path of the slot 17 may be linear or substantially straight so that no lateral movement of the armrest 4 occurs during a translational sliding of the armrest 4 relative to the first member 2.

In some embodiments, a periphery of the upper angle stop 15 and side walls of the slot 17 are configured to define the second angular movement limits. In other words, the interface between the periphery of the upper angle stop 15 and the side walls of the slot 17 define the extent to which the armrest 4 can be angularly adjusted relative to the first member 2.

Figure 11A:
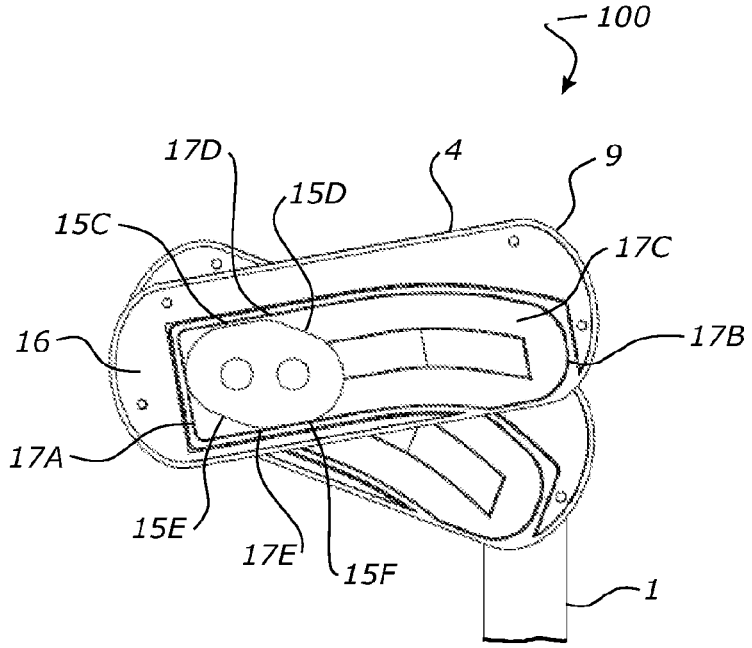
FIG. 11A shows a plan view of the arm assembly and its second angular movement limits.
Figure 11B:
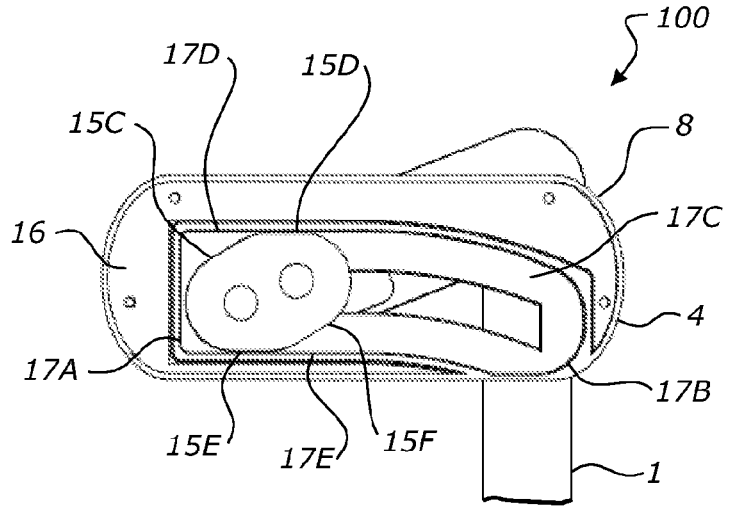
FIG. 11B shows a plan view of the arm assembly and its first angular movement limits.

This is shown in FIGS. 11A and 11B, in which the periphery of the upper angle stop 15 comprises an outer side having a forward wall portion 15C and a rear wall portion 15D that are oriented at an angle of more than 90 degrees and less than 180 degrees relative to each other. The periphery of the upper angle stop 15 also comprises and an inner side having a forward wall portion 15E and a rear wall portion 15F that are oriented at an angle of more than 90 degrees and less than 180 degrees relative to each other.

In various exemplary configurations, the angle between the forward wall portion 15C and the rear wall portion 15D may be more than 90 degrees, more than 95 degrees, more than 100 degrees, more than 105 degrees, more than 110 degrees, more than 115 degrees, more than 120 degrees, more than 125 degrees, more than 130 degrees, more than 135 degrees, more than 140 degrees, more than 145 degrees, or may be about 150 degrees. Additionally or alternatively, the angle may be less than 180 degrees, less than 175 degrees, less than 170 degrees, less than 165 degrees, less than 160 degrees, less than 155 degrees, or may be about 150 degrees. Additionally or alternatively, the angle may be about 91 degrees, about 92 degrees, about 93 degrees, about 94 degrees, about 95 degrees, about 96 degrees, about 97 degrees, about 98 degrees, about 99 degrees, about 100 degrees, about 101 degrees, about 102 degrees, about 103 degrees, about 104 degrees, about 105 degrees, about 106 degrees, about 107 degrees, about 108 degrees, about 109 degrees, about 110 degrees, about 111 degrees, about 112 degrees, about 113 degrees, about 114 degrees, about 115 degrees, about 116 degrees, about 117 degrees, about 118 degrees, about 119 degrees, about 120 degrees, about 121 degrees, about 122 degrees, about 123 degrees, about 124 degrees, about 125 degrees, about 126 degrees, about 127 degrees, about 128 degrees, about 129 degrees, about 130 degrees, about 131 degrees, about 132 degrees, about 133 degrees, about 134 degrees, about 135 degrees, about 136 degrees, about 137 degrees, about 138 degrees, about 139 degrees, about 140 degrees, about 141 degrees, about 142 degrees, about 143 degrees, about 144 degrees, about 145 degrees, about 146 degrees, about 147 degrees, about 148 degrees, about 149 degrees, about 150 degrees, about 151 degrees, about 152 degrees, about 153 degrees, about 154 degrees, about 155 degrees, about 156 degrees, about 157 degrees, about 158 degrees, about 159 degrees, about 160 degrees, about 161 degrees, about 162 degrees, about 163 degrees, about 164 degrees, about 165 degrees, about 166 degrees, about 167 degrees, about 168 degrees, about 169 degrees, about 170 degrees, about 171 degrees, about 172 degrees, about 173 degrees, about 174 degrees, about 175 degrees, about 176 degrees, about 177 degrees, about 178 degrees, about 179 degrees, or between any two of those values.

In various exemplary configurations, the angle between the forward wall portion 15E and the rear wall portion 15F may be more than 90 degrees, more than 95 degrees, more than 100 degrees, more than 105 degrees, more than 110 degrees, more than 115 degrees, more than 120 degrees, more than 125 degrees, more than 130 degrees, more than 135 degrees, more than 140 degrees, more than 145 degrees, or may be about 150 degrees. Additionally or alternatively, the angle may be less than 180 degrees, be less than 175 degrees, be less than 170 degrees, be less than 165 degrees, be less than 160 degrees, be less than 155 degrees, or may be about 150 degrees. Additionally or alternatively, the angle may be about 91 degrees, about 92 degrees, about 93 degrees, about 94 degrees, about 95 degrees, about 96 degrees, about 97 degrees, about 98 degrees, about 99 degrees, about 100 degrees, about 101 degrees, about 102 degrees, about 103 degrees, about 104 degrees, about 105 degrees, about 106 degrees, about 107 degrees, about 108 degrees, about 109 degrees, about 110 degrees, about 111 degrees, about 112 degrees, about 113 degrees, about 114 degrees, about 115 degrees, about 116 degrees, about 117 degrees, about 118 degrees, about 119 degrees, about 120 degrees, about 121 degrees, about 122 degrees, about 123 degrees, about 124 degrees, about 125 degrees, about 126 degrees, about 127 degrees, about 128 degrees, about 129 degrees, about 130 degrees, about 131 degrees, about 132 degrees, about 133 degrees, about 134 degrees, about 135 degrees, about 136 degrees, about 137 degrees, about 138 degrees, about 139 degrees, about 140 degrees, about 141 degrees, about 142 degrees, about 143 degrees, about 144 degrees, about 145 degrees, about 146 degrees, about 147 degrees, about 148 degrees, about 149 degrees, about 150 degrees, about 151 degrees, about 152 degrees, about 153 degrees, about 154 degrees, about 155 degrees, about 156 degrees, about 157 degrees, about 158 degrees, about 159 degrees, about 160 degrees, about 161 degrees, about 162 degrees, about 163 degrees, about 164 degrees, about 165 degrees, about 166 degrees, about 167 degrees, about 168 degrees, about 169 degrees, about 170 degrees, about 171 degrees, about 172 degrees, about 173 degrees, about 174 degrees, about 175 degrees, about 176 degrees, about 177 degrees, about 178 degrees, about 179 degrees, or between any two of those values.

In some embodiments, the forward wall portion 15C of the outer side is substantially parallel to the rear wall portion 15F of the inner side, and the rear wall portion 15D of the outer side is substantially parallel to the forward wall portion 15E of the inner side.

In some embodiments, the forward wall portion 15C of the outer side is configured to engage with an outer side wall 17D of the slot 17 and the rear wall portion 15F of the inner side is configured to engage with an inner side wall 17E of the slot 17, to define the inward angular adjustment limit of the second angular movement limits.

This is shown in FIG. 11A, in which the armrest 4 is at the maximum inward angular adjustment position 9 relative to the first member 2. In this maximum inward angular adjustment position 9, a front end of the armrest 4 has moved to an angular position of about 10 degrees inwardly from a neutral position of the armrest 4 relative to the first member 2, as described above in relation to A9 in FIG. 5. Therefore, FIG. 11A makes it apparent how the periphery of the upper angle stop 15 can be configured to define the maximum inward angular adjustment of the front end of the armrest 4 relative to the first member 2.

In some embodiments, the rear wall portion 15D of the outer side is configured to engage with an outer side wall 17D of the slot 17 and the forward wall portion 15E of the inner side is configured to engage with an inner side wall 17E of the slot 17, to define an outward angular adjustment limit of the second angular movement limits.

This is shown in FIG. 11B, in which the armrest 4 is at the maximum outward angular adjustment position 8 relative to the first member 2. In this maximum outward angular adjustment position 8, a front end of the armrest 4 has moved to an angular position of about 21 degrees outwardly from a neutral position of the armrest 4 relative to the first member 2, as described above in relation to A8 in FIG. 5. Therefore, FIG. 11B makes it apparent how the periphery of the upper angle stop 15 can be configured to define the maximum outward angular adjustment of the front end of the armrest 4 relative to the first member 2.

FIG. 12 shows an adjusted position of the arm assembly 100 in which the first member 2 is at its maximum inward angular adjustment position 7, the armrest 4 is at its frontmost translational position 19 and the rear portion 15F of the inner side of the periphery of the upper angle stop 15 interfaces wholly with the inner side wall 17E of the slot 17. This thereby defines the ultimate inward angular adjustment position 24 of the armrest 4, in which a front end of the armrest 4 has moved to an angular displacement A24 of about 55 degrees inwardly from a neutral position of the armrest 4 relative to the first member 2. Although a gap is shown between the rear portion 15D of the outer side of the periphery of the upper angle stop 15 and the outer side wall 17D of the slot 17, the outer side wall 17D of the slot may be shaped to contact and interface wholly with the rear portion 15D.

Figure 13A:
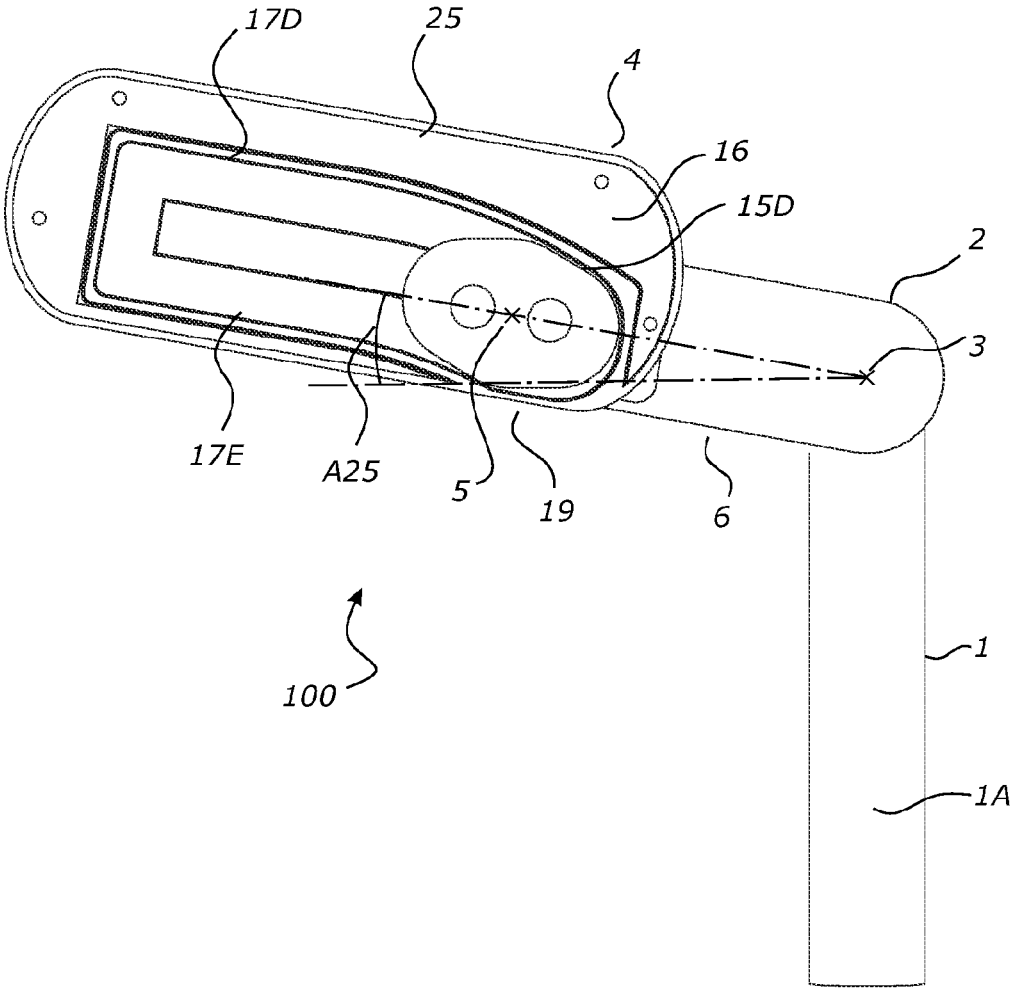
FIG. 13A shows a plan view of the arm assembly and its ultimate outward angular adjustment position in a frontmost translational position of the armrest.

FIG. 13A shows an adjusted position of the arm assembly 100 in which the first member 2 is at its maximum outward angular adjustment position 6, the armrest 4 is at its frontmost translation position 19 and the rear portion 15D of the outer side of the periphery of the upper angle stop 15 interfaces wholly with the outer side wall 17D of the slot 17. This thereby defines the ultimate outward angular adjustment position 25 of the armrest 4 when the armrest 4 is at its frontmost translation position 19, in which a front end of the armrest 4 has moved to an angular displacement A25 of about 10 degrees outwardly from a neutral position of the armrest 4 relative to the post 1. In the configuration shown, the angular displacement of the armrest 4 relative to the first member 2 has not changed.

Figure 13B:
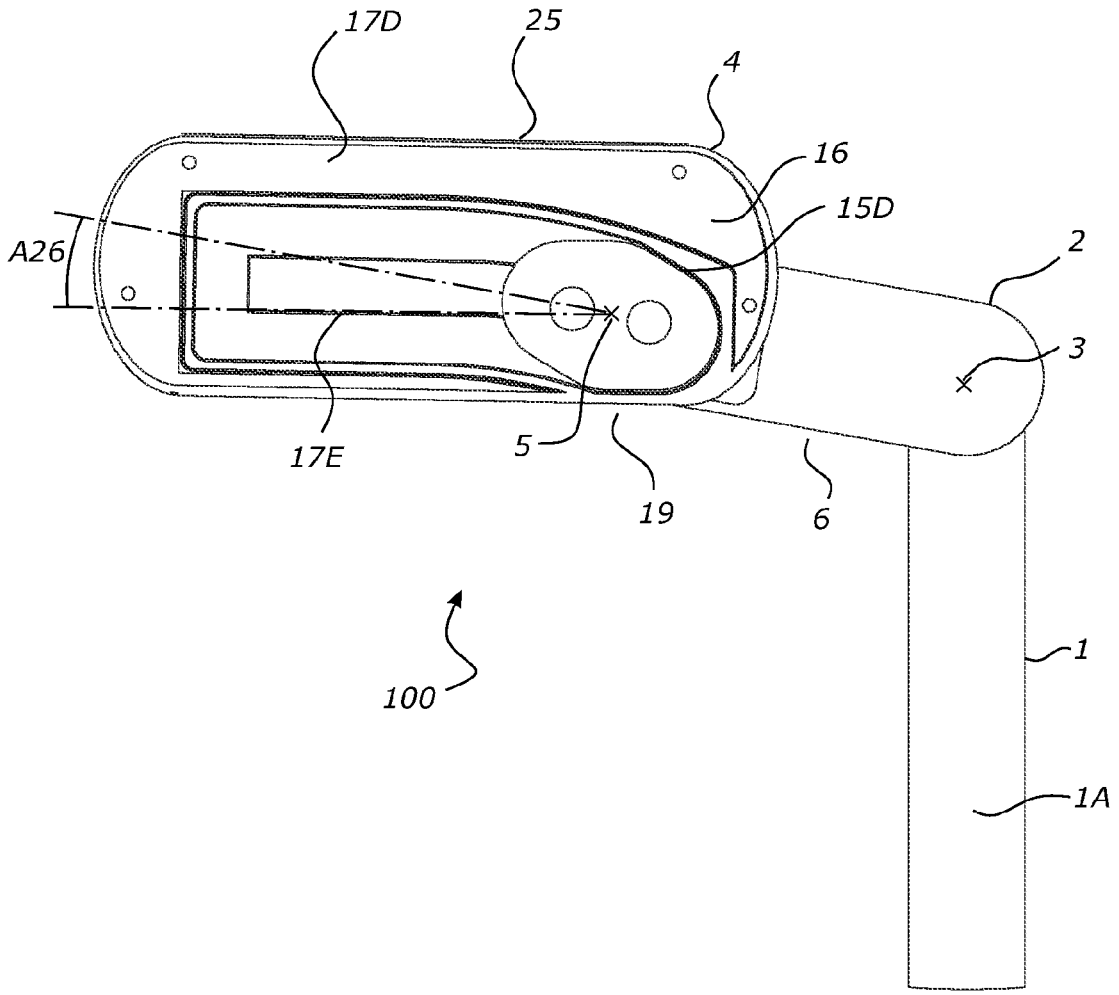
FIG. 13B shows a plan view of an alternative configuration of the arm assembly in a frontmost translational position of the armrest.

Although a gap is shown between the rear portion 15F of the inner side of the periphery of the upper angle stop 15 and the inner side wall 17E of the slot 17, the inner side wall 17E of the slot may be shaped to contact and interface wholly with the rear portion 15F. Such a configuration is shown in FIG. 13B. In the configuration shown, in the frontmost translational position 19, the armrest 4 cannot be angularly adjusted outwardly relative to the first member 2 about the second substantially upright axis 5 as the periphery of the upper angle stop 15 is substantially encompassed by and engaged with the inner and outer side walls 17D, 17E and rear edge 17B of the slot 17 such that no clearance is available for outward angular adjustment of the armrest 4 about the periphery of the upper angle stop 15.

This adds to the stability of the armrest 4 when it is in the frontmost translational position 19. However, in the configuration of FIG. 13A, the armrest 4 may still be angularly adjusted inwardly relative to the first member 2 about the second substantially upright axis 5, when in the frontmost translational position 19.

Alternatively, a rear portion of the inner and outer side walls 17D, 17E and the rear edge 17B of the slot 17 may be configured so as to permit angular adjustment of the first member 2 about the second substantially upright axis 5 when the first member 2 is at the frontmost translational position 19.

In the configuration of FIG. 13A, the angle of the armrest 4 relative to the first member 2 does not change as a consequence of the armrest 4 being moved to its most forward position. In an alternative configuration, the angle of the armrest 4 relative to the first member 2 may change as a consequence of the armrest being moved to its most forward position. For example, in the configuration of FIG. 13B, the front end of the armrest 4 has moved to an angular displacement A26 of about 10 degrees inwardly from a neutral position of the armrest 4 relative to the first member 2.

In some configurations, the inward angular displacement A26 may be the same as the outward angular displacement A25. In other configurations, the inward angular displacement A26 may be less than the outward angular displacement A25.

In some embodiments, the features, functions and working principles of the slot 17 and upper angle stop 15 described above in relation to translation adjustment of the armrest 4 relative to the first member 2 are exchanged or swapped such that the slot 17 is instead provided within an upper surface of the first member 2 and the upper angle stop instead extends from a lower surface of the armrest 4 into the slot 17. In such embodiments, the features, functions and working principles described above in relation to translation adjustment of the armrest 4 relative to the first member 2 remain substantially the same.

In the configuration shown in FIGS. 14-21, the post 1 comprises a substantially upright inner post member 26 and the first member 2 comprises an outer housing 27 that is slidably mounted on and receives the inner post member 26 in a telescopic arrangement, such that the height of the outer housing 27 is adjustable relative to the inner post member 26. The outer housing 27 is also angularly adjustable relative to the inner post member 26 about the first substantially upright axis 3 between the first angular movement limits.

The height adjustability of the armrest 4 relative to the inner post member 26 is thus provided by the below described arrangement of the outer housing 27 and inner post member 26.

Figure 16:
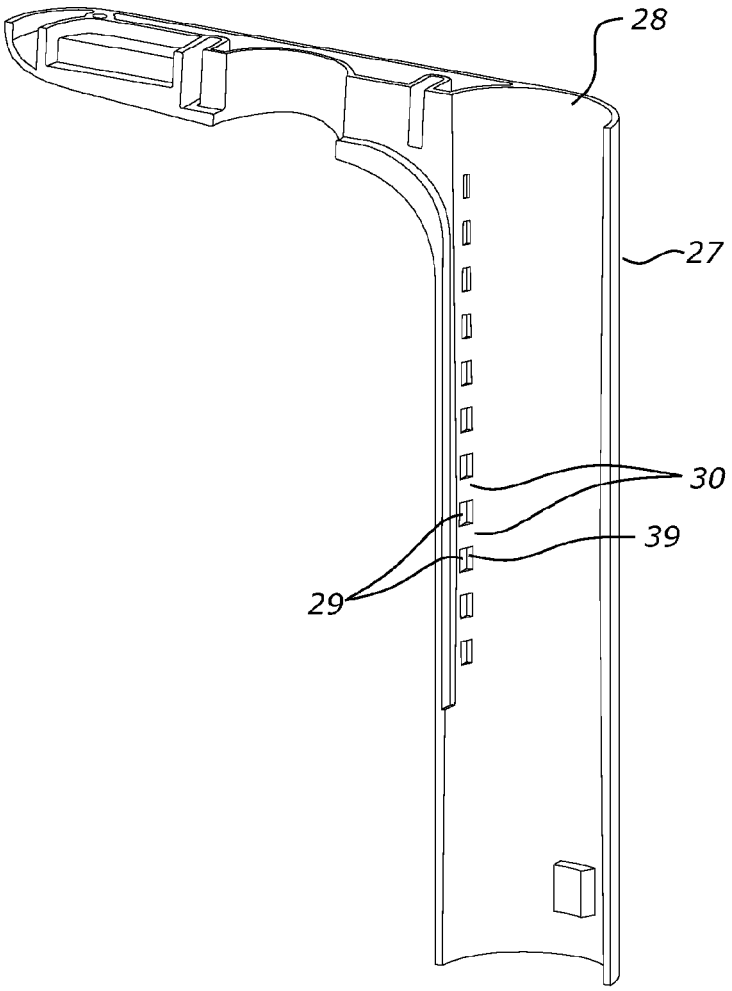
FIG. 16 shows a cross-sectional perspective view of the outer housing of the arm assembly.
Figure 21:
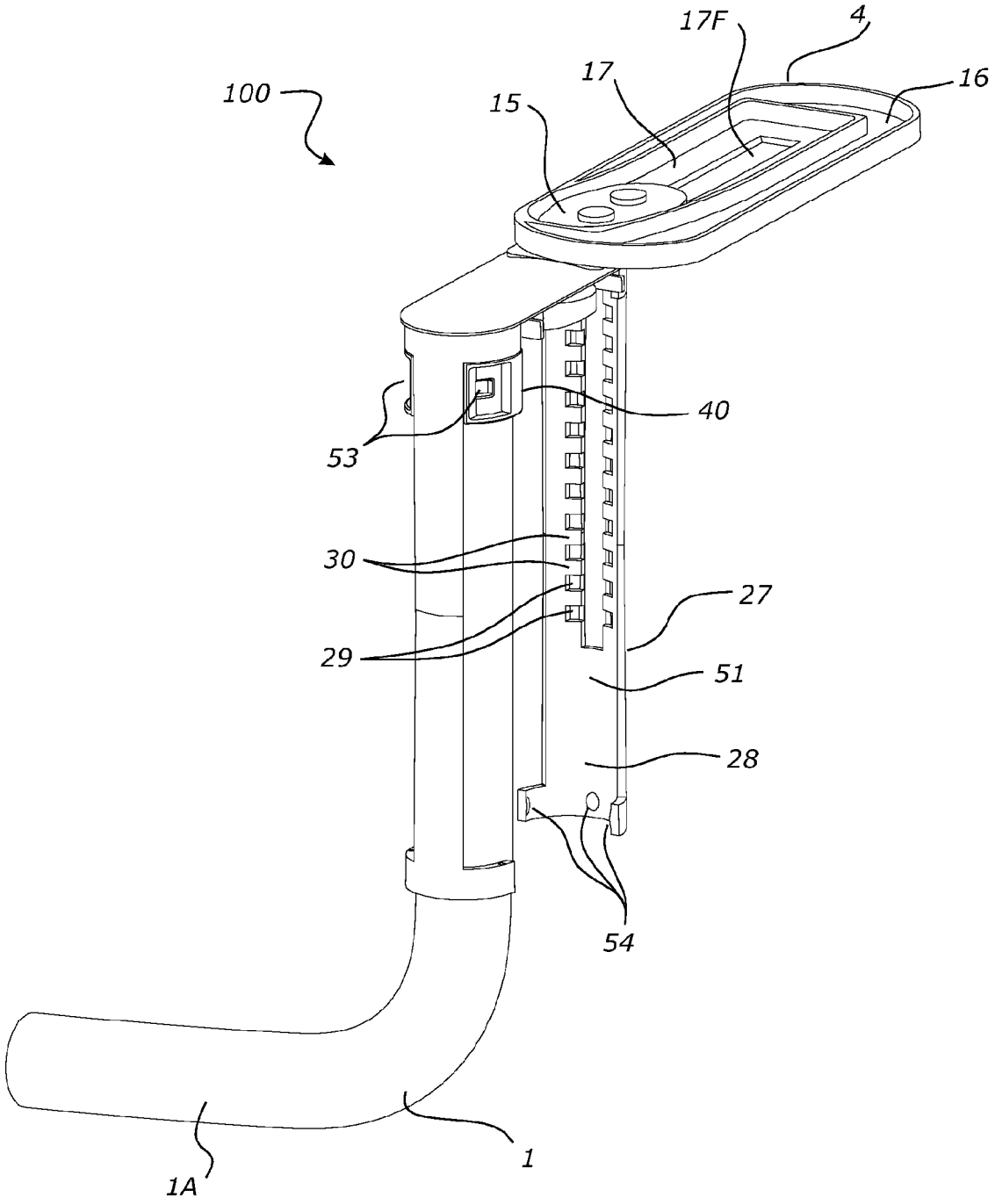
FIG. 21 shows an exploded perspective view of the outer housing of the arm assembly.

As shown in FIGS. 16 and 21, the outer housing 27 comprises a plurality of recesses 29 disposed within an interior 28 of the outer housing 27 and provided along a length thereof. The recesses 29 also have raised surfaces 30 therebetween that are flush with the interior 28 of the outer housing 27. The outer housing 27 may comprise a single column of recesses 29 and raised surfaces 30, or may have two or more spaced-apart columns of recesses 29 and raised surfaces 30.

The recesses 29 may be integrally formed with the outer housing 27 or may be provided on a liner component 51 that is assembled together with an outer housing member to form the outer housing 27. In such configurations, the liner component 51 is assembled such that the raised surfaces 30 remain flush with the interior 28 of the outer housing 27.

Figure 14:
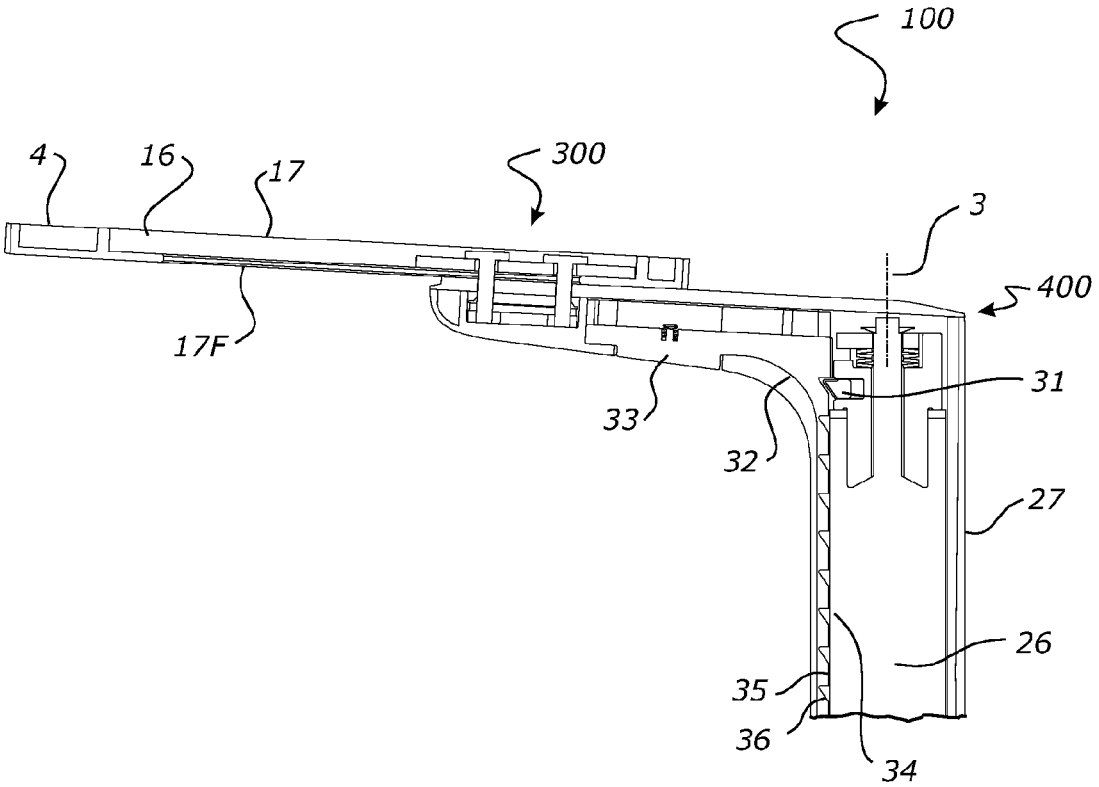
FIG. 14 shows a cross-sectional side view of the arm assembly with the release member in its first position.
Figure 15:
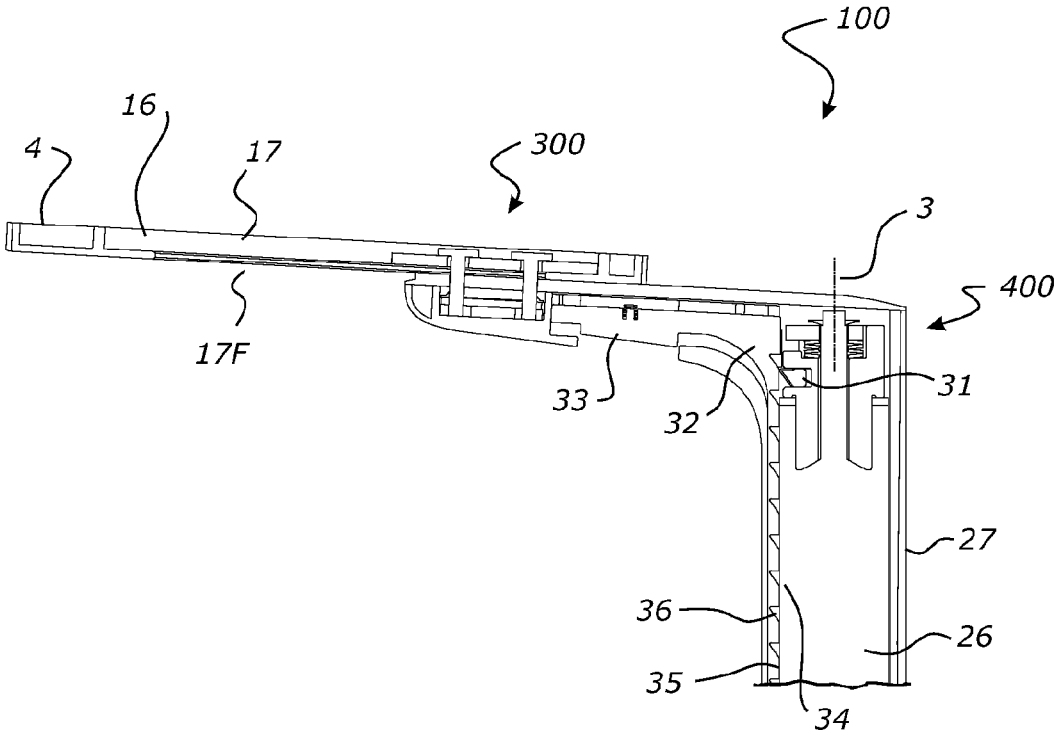
FIG. 15 shows a cross-sectional side view of the arm assembly with the release member in its second position.

FIGS. 14 and 15 show the inner post member 26 comprising a locking member 31 biased to engage with one of the plurality of recesses 29 of the outer housing 27 to lock the position of the outer housing 27 relative to the inner post member 26.

The outer housing 27 comprises a release member 32 in operable connection with an actuator 33. The release member 32 is an elongate member having a plurality of recesses 34 with raised surfaces 35 therebetween, the release member 32 being located within the interior 28 of the outer housing 27. The housing 27 may have an elongate cavity to receive the release member 32. The elongate cavity may be adjacent the column(s) of recesses 29. The release member 32 is slidably moveable relative to the outer housing 27 between a first position shown in FIG. 14 and a second position shown in FIG. 15.

The first position of FIG. 14 shows at least one of the recesses 34 in the release member 32 aligned with at least one of the recesses 29 of the outer housing 27, and the locking member 31 engaging at least one of the recesses 29 in the outer housing 27 to inhibit telescopic movement of the outer housing 27 relative to the inner post member 26. Therefore, in this first position, height adjustment of the outer housing 27 relative to the inner post member 26 is inhibited.

The second position of FIG. 15 shows the one or more of the raised surfaces 35 of the release member 32 aligned with the one or more recesses 29 of the outer housing 27 to remove the locking member 31 from engagement with the recess or recesses 29 and to provide a surface over which the locking member 31 can slide to enable relative movement between the outer housing 27 and the inner post member 26. Therefore, in this second position, height adjustment of the outer housing 27 relative to the inner post member 26 is permitted.

The actuator 33 is shown in FIGS. 14 and 15 as being a unitary component formed with the release member 32. In some configurations, the actuator 33 may not be unitary component formed with the release member 32 but may be a separate component operatively coupled to or connected with the release member 32.

The outer housing 27 is shown having an opening on a lower surface of the outer housing 27 within which the actuator 33 is disposed. Therefore, a user may depress the actuator 33 upwardly to cause an upward movement of the release member 32. The opening through which the actuator 33 is disposed is shown in FIGS. 1, 2 and 14-16 as being disposed on a lower surface of the outer housing 27 and having a generally circular shape; however, it may instead be disposed on any other surface of the outer housing 27 and may have any suitable shape so as to provide easy and intuitive access and operation by a user of the chair 200.

Figure 17:
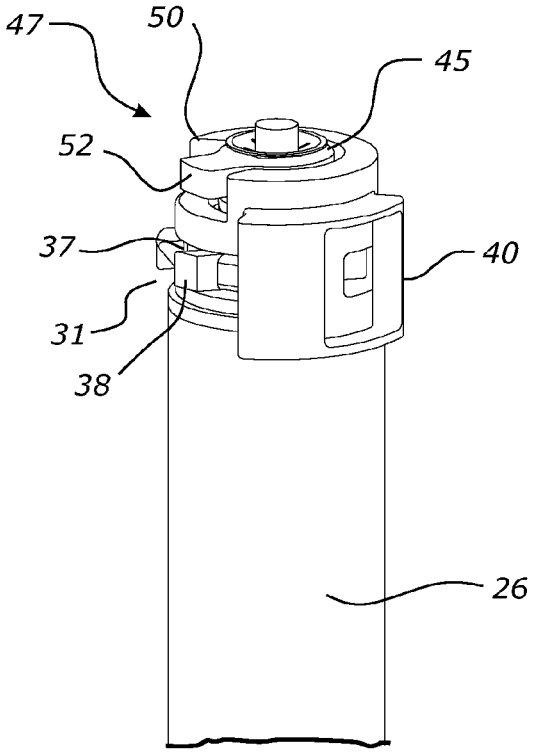
FIG. 17 shows a perspective view of the lock housing of the arm assembly with the locking member in its engaged position.
Figure 18:
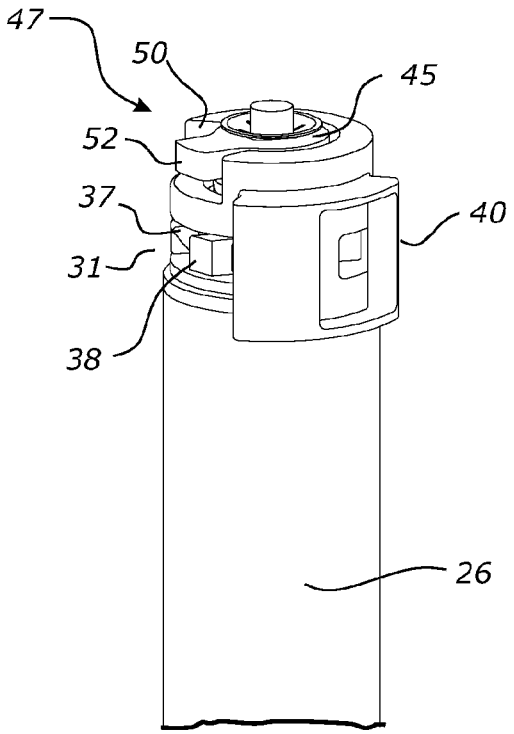
FIG. 18 shows a perspective view of the lock housing of the arm assembly of the with the locking member in its disengaged position.

The recesses 34 of the release member 32 are shown having a ramped lower surface 36, as shown in FIGS. 14 and 15, that corresponds to a ramped lower surface 37 of the locking member 31, as shown in FIGS. 17 and 18. Therefore, an upward movement of the release member 32 triggered by operation of the actuator 33 causes the ramped lower surface 36 of the recesses 34 to slide along the ramped lower surface 37, and therefore move the locking member 31 inwardly closer to the inner post member 26 and thus out of engagement with recesses 29, 34 in accordance with the second position of the release member 32.

FIGS. 17 and 18 also show the locking member 31 having a rectangular or square-shaped protrusion 38 that corresponds to the general profile 39 of the recesses 29 of the outer housing 27. Therefore, different portions of the locking member 31 engage with the recesses 29 of the outer housing 27 and the recesses 34 of the release member 32. FIGS. 17 and 18 illustrate the position of the locking member 31 when it is engaged or disengaged in accordance with the first and second positions of the release member 32.

When there are two spaced-apart columns of recesses 29 and raised surfaces 30, the locking member will have two spaced apart protrusions 38.

The travel of the release member 32 from the first position to the second position and the dimensions of the recesses 29, raised surfaces 30, recesses 34 and raised surfaces are configured appropriately so that in this second position, the raised surfaces 30 align with the recesses 34 and the raised surfaces 35 align with the recesses 29, such that the locking member 31 remains disengaged as it slides over either the raised surfaces 35 of the release member 32 or the raised surfaces 30 of the outer housing 27, during a sliding movement of the outer housing 27 relative to the inner post member 26. Therefore, the sliding movement of the outer housing 27 relative to the inner post member 26 while the release member 32 is in this second position is smooth, seamless and uninterrupted.

The locking member 31 may be biased towards engagement with recesses 29, 34 by any suitable means such as a spring member. Likewise, the actuator 33, and thus the release member 32, are biased towards the first position by any suitable means such as a spring member. Thus, upon release of the actuator 33 by a user, the release member 32 returns to its first position, however the locking member 31 will not reengage with the recesses 29, 34 until the height of the outer housing 27 is adjusted to a position where the recesses 29, 34 align.

FIGS. 14, 15, 17 and 18 also show a lock housing 40 which carries the locking member 31. The lock housing 40 is rotatably mounted to the inner post member 26 and keyed to the outer housing 27 to inhibit relative rotation between the lock housing and the outer housing such that upon an angular adjustment of the first member 2 relative to the post 1, and thus an angular adjustment of the outer housing 27 relative to the inner post member 26, the lock housing 40 undergoes a corresponding angular adjustment relative to the post 1 and inner post member 26. As a result, all the above described components that provide the height adjustable functionality of the arm assembly 100 rotate equally with one another about the first substantially upright axis 3 while remaining aligned so as to permit height adjustability irrespective of the angular position or adjustment of said components.

During height-adjustment of the outer housing 27 relative to the inner post member 26, and at any vertical translational position of the outer housing 27 relative to the inner post member 26, the outer housing 27 slides substantially along the inner post member 26 as well as the lock housing 40, however a bottommost portion of the outer housing 27 always remains in contact with the inner post member 26.

Figure 19:
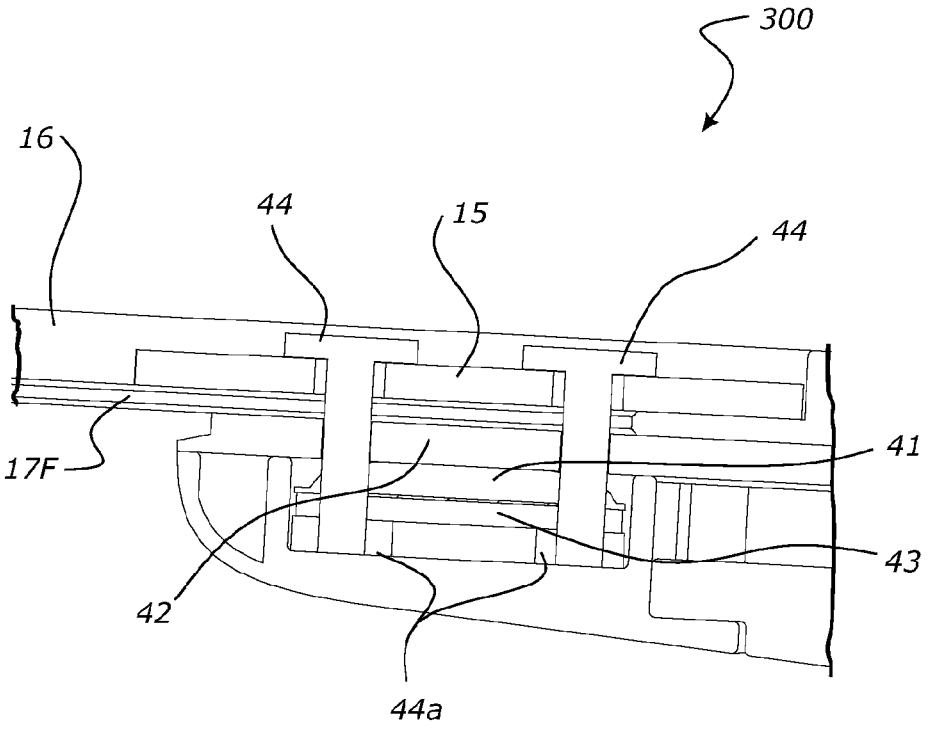
FIG. 19 shows a cross-sectional side view of the first frictional arrangement of the arm assembly.

FIG. 19 shows a cross sectional view of a first frictional arrangement 300 associated with the upper angle stop 15. The first frictional arrangement 300 is configured to provide a first frictional force that must be overcome by a user to translationally slide and angularly adjust the armrest 4 relative to the first member 2. This means the position of the armrest 4 relative to the first member 2 will not be disrupted unless the user intentionally applies a force that overcomes the first frictional force.

In some embodiments, the first frictional arrangement 300 comprises a biasing device to bias the slide plate 16 into contact with the upper angle stop 15 to provide the first frictional force.

As shown in FIG. 19, this biasing device comprises a spring member 41 which acts against an upper surface 42 of the first member 2 and against a spring plate 43 disposed underneath the spring member 41. Inherently, this creates a reaction force which causes the upper angle stop 15 to push, or 'clamp' the slide plate 16 down onto the upper surface 42 of the first member 2, thereby providing friction to both translational sliding and angular adjustment of the armrest 4 relative to the first member 2.

The spring member 41 may be a leaf spring or any other suitable spring or resilient member.

In some embodiments, an adjuster is provided to allow adjustment of the first frictional force provided by the first frictional arrangement 300. For instance, FIG. 19 shows mounting bolts 44 that are operatively coupled to the first frictional arrangement 300 by lock nuts 44*a*. The torque set on these lock nuts 44*a* thereby determines the extent to which the mounting bolts 44 push down onto the first frictional arrangement 300. These mounting bolts 44 extend through the lower slit 17F of the slot 17. The general shape or path of the lower slit 17F may therefore correspond or match the general shape or path of the slot 17 such that the mounting bolts 44 don't contact the periphery of the lower slit 17F at any position of the armrest 4 relative to the first member 2.

Thus, the torque set on these lock nuts 44*a* determines the magnitude of the biasing force of the spring member 41, and the resulting reactionary force that causes the upper angle stop 15 to push, or 'clamp' the slide plate 16 down onto the upper surface 42 of the first member 2. As a result, these lock nuts 44*a* generally govern the amount of first frictional force provided by the first frictional arrangement 300. The torque applied by these lock nuts 44*a* may be set during assembly of the arm assembly 100.

Figure 20:
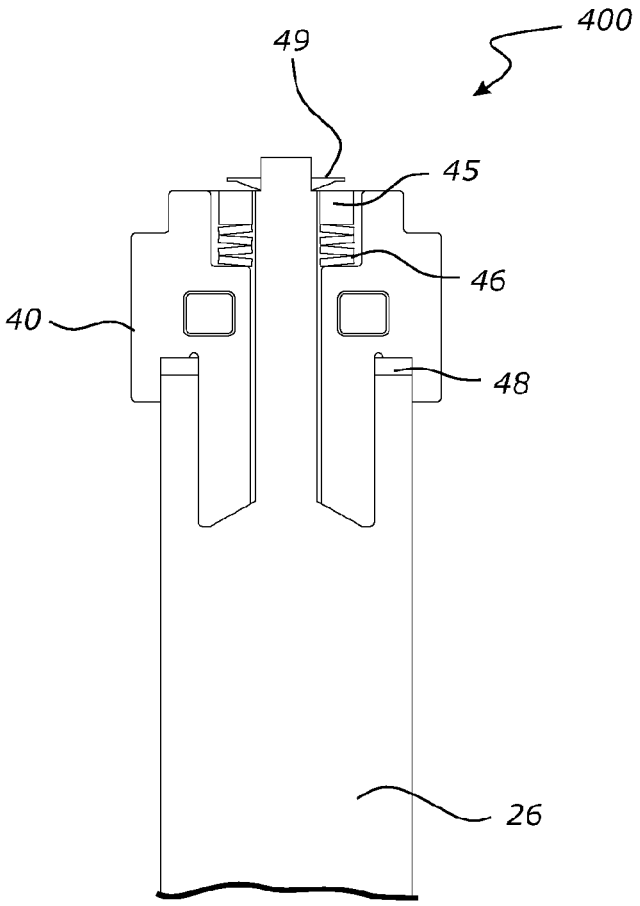
FIG. 20 shows a cross-sectional side view of the second frictional arrangement of the arm assembly.

FIG. 20 shows a cross sectional view of the arm assembly 100 having a second frictional arrangement 400. The second frictional arrangement 400 is configured to provide a second frictional force that must be overcome by a user to angularly adjust the first member 2 relative to the post 1. This ensures the position of the first member 2 relative to the post 1 will not be disrupted unless the user intentionally applies a force that overcomes the second frictional force.

In some embodiments, the second frictional arrangement 400 comprises a biasing device to bias a portion of the first member 2 into contact with the post 1 to provide the second frictional force.

In some embodiments, this portion of the first member 2 may be the above described lock housing 40, as shown in FIG. 20. FIG. 20 shows that the biasing device of the second frictional arrangement 400 comprises a spring member 46 which acts against an upper member 45 provided atop the spring member 46. Inherently, this creates a reaction force which causes the lock housing 40 to push, or 'clamp' down onto a bearing member 48 atop which the lock housing 40 is mounted. This bearing member 48 is rotatably mounted to the inner post member 26 and thus this arrangement thereby provides friction to angular adjustment of the lock housing 40, and thus the outer housing 27, relative to the inner post member 26, and thus post 1.

In some embodiments an adjuster is provided to allow adjustment of the second frictional force provided by the second frictional arrangement 400. For instance, FIG. shows a starlock washer 49 that is operatively coupled to the second frictional arrangement 400 and disposed atop the upper member 45. The compression applied by the starlock washer 49 thereby determines the extent to which the upper member 45 pushes down onto the second frictional arrangement 400.

Thus, the compression applied by the starlock washer 49 determines the magnitude of the biasing force of the spring member 46, and the resulting reactionary force that causes the lock housing 40 to push, or 'clamp' down onto a bearing member 48 atop which the lock housing 40 is mounted. As a result, this starlock washer 49 generally governs the amount of second frictional force provided by the second frictional arrangement 400. The compression applied by the starlock washer 49 may be set during assembly of the arm assembly 100.

In the above described embodiments, the arm assembly may be height adjustable and provided with the locking member 31 and thus lock housing 40 required for height adjustability. Thus, as described above, the portion of the first member 2 described above is the lock housing 40.

However, in alternative embodiments, the arm assembly may not be height adjustable and thus not provided with a locking member 31 and thus lock housing 40. In that configuration, the portion of the first member 2 described above may be a component keyed to the first member 2 such that it permits angular adjustment of the first member 2 and the outer housing 27 relative to the post 1 and inner post member 26, about the first substantially upright axis 3. This component may also operate in substantially the same manner as the lock housing 40 with regard to providing a part within which the second frictional arrangement 400 is disposed as shown in FIG. 20.

In some embodiments, the component keyed to the first member 2 and mounted to the post 1 and/or the lock housing 40 depending on the configurations described above, comprises a lower angle stop 47 positioned at the first substantially upright axis 3. In any case, the upper member 45 described above in relation to the second frictional arrangement 400 comprises the lower angle stop 47.

The lower angle stop 47 is configured to define the first angular movement limits and thus define the maximum outward angular adjustment of the first member 2 relative to the post 1 and the maximum inward angular adjustment of the first member 2 relative to the post 1, as described above in relation to FIG. 4.

In other words, the interface between the lower angle stop 47 and the post 1, and thus inner post member 26, define the extent to which the first member 2 and outer housing 27 can be angularly adjusted relative to the post 1 and inner post member 26.

This is best shown in FIGS. 17 and 18, in which the lower angle stop 47 is interfaced with the post 1, and thus inner post member 26, such that it cannot be angularly adjusted relative to the post 1, and inner post member 26. Therefore, upon angular adjustment of the component keyed to the first member 2 and mounted to the post 1 and/or angular adjustment of the lock housing 40, both corresponding to angular adjustment of the first member 2 and outer housing 27 about the first substantially upright axis 3, side walls of a recess 50 of the component keyed to the first member 2 and/or the lock housing 40 will abut a projection 52 of the lower angle stop 47 so as to prevent further angular adjustment of the first member 2 and outer housing 27 relative to the post 1 and inner post member 26.

FIG. 21 shows an embodiment of the arm assembly with the outer housing 27 shown in an exploded view. Provided between the outer housing 27 and the inner post member 26 is a damping arrangement configured to inhibit lateral movement of the first member 2 relative to the post 1.

In an embodiment, the damping arrangement comprises at least one first biasing member 53 extending between the lock housing 40 and an internal wall 51 of the outer housing and at least one second biasing member 54 extending between the inner post member 26 and the internal wall 51 of the outer housing 27, the at least one first and second biasing members 53, 54 being spaced apart in a vertical direction.

As described above in relation to the height adjust components, the outer housing 27 may be integrally formed, such that the at least one first biasing member 53 extends between the lock housing 40 and the internal wall 51 of the outer housing 27, and such that the at least one second biasing member 54 extends between the inner post member 26 and an internal wall 51 of the outer housing 27.

However, if the outer housing 27 instead comprises a liner component 51 that is assembled together with an outer housing member to form the outer housing 27, the at least one first biasing member 53 instead extends from the lock housing 40 to the internal wall of the linear component 51, and the at least one second biasing member 54 instead extends from an internal wall of the liner component 51 that forms the internal wall of the outer housing 27, to the inner post member 26 as shown in FIG. 21.

The at least one first and second biasing members 53, 54 may comprise any suitable biasing means such as a spring or resilient member. The damping arrangement helps to reduce any play or wobble between the outer housing 27 and the inner post member 26 during a translational sliding or height adjustment of the outer housing 27 relative to the inner post member 26 and during an angular adjustment of the of the first member 2 and outer housing 27 relative to the post 1 and inner post member 26. Therefore, the sliding movement of the outer housing 27 relative to the inner post member 26 during a height adjustment of the same and a rotational movement of the outer housing 27 relative to the inner post member 26 during an angular adjustment of the same is smooth and seamless with minimal to no lateral translational movement.

In some embodiments, the outer housing 27 slidably receives the post 1 in a telescopic arrangement such that the height of the first member 2 is adjustable relative to the post 1. In such an embodiment, the above described features, functions and working principles of the inner post member 26 in relation to the height adjust arrangement, second frictional arrangement, lock housing arrangement and damping arrangement as described in relation to FIGS. 14-18 and 20 apply similarly to the post 1.

In some embodiments, the first member 2 may not comprise an outer housing 27 but may instead comprise a first and second housing wherein the first housing is fixedly or non-rotatably mounted to the post 1 and comprises the features, functions and working principles of the outer housing 27 in relation to the height adjust arrangement, lock housing arrangement and damping arrangement described above; and wherein the second housing is rotatably mounted to the first housing to be angularly adjustable about the first substantially upright axis 3 between first movement limits and may also comprise at least some of the features, functions and working principles of the outer housing 27 in relation to the lock housing arrangement described above. Therefore, the angular adjustment and height adjustment of the first member 2 relative to the post 1 may be provided by separate housings so as to allow for easier or more modular assembly of the arm assembly.

In some embodiments, the outer housing 27 may be an integrally formed or unitary component, or may comprise a subassembly of an outer housing member and liner component that are assembled together to form the outer housing 27.

In any of the above described embodiments of the first member 2, the damping arrangement is provided between an interior of the first member 2 and the outer surface of the post 1 so as to engage with the first member 2 and the post 1 without necessarily being connected to or formed with either of those components.

The arm assemblies described herein are particularly suited for use on a chair having a work or office application, for example a task chair or office chair having a pedestal type height adjustable base and/or a swivel base. The arm assemblies described herein could also be used in any other suitable seating application, including but not limited to dining chairs, multipurpose chairs, cafeteria chairs, restaurant chairs, breakout space chairs, and meeting environment chairs.

The arm assemblies described herein allow for adjustability in multiple directions or planes such as height, width and depth relative to the chair. The width and depth adjustment of the armrest of the arm assembly is achieved through a combination of angular adjustment in a generally horizontal plane about multiple axes, as well as a translational adjustment in the generally horizontal plane. The height adjustment of the armrest is achieved through translation adjustment in generally vertical direction or plane.

The arm assemblies described herein also provide substantially free adjustment between movement limits in each of the width and depth directions. As a result, a user can smoothly adjust the lateral and longitudinal position of the armrest relative to the chair without the harsh, clunky or awkward movements typical of indexed or discretised adjustability mechanisms that do not possess an indeterminate or non-finite number of adjustment positions.

Frictional arrangements described herein may be provided such that the lateral and longitudinal adjustment of the armrest does not occur in the absence of a user applied force. This enables a user to set the position of the armrest relative to the chair to suit their sitting preference, with confidence that the position of the armrest will not be disrupted unless the user intentionally applies a force that overcomes these frictional arrangements. This is especially useful if a chair is provided with an arm assembly on both sides of the chair, so that a user can mirror and match the positions of both armrests to suit their sitting preferences. The frictional arrangements also help to improve the smoothness of the adjustment of the armrest in the width and depth directions. In some configurations, one or more of the frictional arrangements can be adjusted to provide increased or reduced resistance to movement.

The frictional arrangements also enable the width and depth positions of the armrest without requiring a user to release an actuator, thereby simplifying the adjustment.

Preferred embodiments of the invention have been described by way of example only and modifications may be made thereto without departing from the scope of the invention.

For example, the specific values of displacements A6-A26 described in this specification with reference to the movement of components of the arm assembly 100 are indicative only of one exemplary configuration of the arm assembly 100. The specific values of displacements are determined in part by the magnitude of the first and second angular movement limits and first translational movement limits. Thus, these specific values may change in other exemplary configurations of the arm assembly 100 where the magnitudes of the first and second angular movement limits and first translational movement limits are different to those described in this specification and claims. This applies equally to the physical configuration and geometry of any components of the arm assembly 100 that determine, define or influence the magnitude of these movement limits.

For instance, the below Table 1 sets out exemplary ranges of values possible for each of the displacements A6-A26 when the magnitudes of the first and second angular movement limits are increased or decreased by various degrees and magnitudes of the first translational movement limits are increased or decreased by various millimetres.

The 'lower' values indicate the lowest possible values for each of the respective displacements when the movement limits are adjusted as such; the 'upper' values indicate the highest possible values of the respective displacements when the movement limits are adjusted as such; and the 'default' values indicate the nominal values as described above in this specification and claims.

Any values within these ranges are possible and, indeed, different values outside these ranges are possible for different configurations of the arm assembly.

TABLE 1

| | Lower Values | Default Values | Upper Values |
|---|---|---|---|
| Displacements (mm) | | | |
| A11 | 0 | 34 | 94 |
| A13 | 0 | 16 | 66 |
| A21 | 40 | 80 | 120 |
| A22 | 0 | 6.6 (~7) | 21.8 (~22) |
| Displacements (degrees) | | | |
| A6 | 0 | 10 | 40 |
| A7 | 0 | 45 | 90 |
| A8 | 0 | 21 | 45 |
| A9 | 0 | 10 | 40 |
| A10 | 0 | 21 | 45 |
| A12 | 0 | 10 | 40 |
| A24 | 0 | 55 | 90.4 (~90) |
| A25 | 0 | 10 | 40 |
| A26 (inward) | 0 | 10 | 40 |

In various exemplary configurations, displacement A11 may be at least about 0 mm, at least about 5 mm, at least about 10 mm, at least about 15 mm, at least about 20 mm, at least about 25 mm, or at least about 30 mm. Additionally or alternatively, displacement A11 may be up to about 94 mm, up to about 90 mm, up to about 85 mm, up to about 80 mm, up to about 75 mm, up to about 70 mm, up to about 65 mm, up to about 60 mm, up to about 55 mm, up to about 50 mm, up to about 45 mm, up to about 40 mm, or up to about 35 mm. Additionally or alternatively, displacement A11 may be about 0 mm, about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, about 24 mm, about 25 mm, about 26 mm, about 27 mm, about 28 mm, about 29 mm, about 30 mm, about 31 mm, about 32 mm, about 33 mm, about 34 mm, about 35 mm, about 36 mm, about 37 mm, about 38 mm, about 39 mm, about 40 mm, about 41 mm, about 42 mm, about 43 mm, about 44 mm, about 45 mm, about 46 mm, about 47 mm, about 48 mm, about 49 mm, about 50 mm, about 51 mm, about 52 mm, about 53 mm, about 54 mm, about 55 mm, about 56 mm, about 57 mm, about 58 mm, about 59 mm, about 60 mm, about 61 mm, about 62 mm, about 63 mm, about 64 mm, about 65 mm, about 66 mm, about 67 mm, about 68 mm, about 69 mm, about 70 mm, about 71 mm, about 72 mm, about 73 mm, about 74 mm, about 75 mm, about 76 mm, about 77 mm, about 78 mm, about 79 mm, about 80 mm, about 81 mm, about 82 mm, about 83 mm, about 84 mm, about 85 mm, about 86 mm, about 87 mm, about 88 mm, about 89 mm, about 90 mm, about 91 mm, about 92 mm, about 93 mm, about 94 mm, or between any two of those values.

In various exemplary configurations, displacement A13 may be at least about 0 mm, at least about 5 mm, at least about 10 mm, or at least about 15 mm. Additionally or alternatively, displacement A13 may be up to about 66 mm, up to about 65 mm, up to about 60 mm, up to about 55 mm, up to about 50 mm, up to about 45 mm, up to about 40 mm, up to about 35 mm, up to about 30 mm, up to about 25 mm, or up to about 20 mm. Additionally or alternatively, displacement A13 may be about 0 mm, about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, about 24 mm, about 25 mm, about 26 mm, about 27 mm, about 28 mm, about 29 mm, about 30 mm, about 31 mm, about 32 mm, about 33 mm, about 34 mm, about 35 mm, about 36 mm, about 37 mm, about 38 mm, about 39 mm, about 40 mm, about 41 mm, about 42 mm, about 43 mm, about 44 mm, about 45 mm, about 46 mm, about 47 mm, about 48 mm, about 49 mm, about 50 mm, about 51 mm, about 52 mm, about 53 mm, about 54 mm, about 55 mm, about 56 mm, about 57 mm, about 58 mm, about 59 mm, about 60 mm, about 61 mm, about 62 mm, about 63 mm, about 64 mm, about 65 mm, about 66 mm, or between any two of those values.

In various exemplary configurations, displacement A21 may be at least about 40 mm, at least about 45 mm, at least about 50 mm, at least about 55 mm, at least about 60 mm, at least about 65 mm, at least about 70 mm, at least about 75 mm, or at least about 80 mm. Additionally or alternatively, displacement A21 may be up to about 120 mm, up to about 115 mm, up to about 110 mm, up to about 105 mm, up to about 100 mm, up to about 95 mm, up to about 90 mm, up to about 85 mm, or up to about 80 mm. Additionally or alternatively, displacement A21 may be about 40 mm, about 41 mm, about 42 mm, about 43 mm, about 44 mm, about 45 mm, about 46 mm, about 47 mm, about 48 mm, about 49 mm, about 50 mm, about 51 mm, about 52 mm, about 53 mm, about 54 mm, about 55 mm, about 56 mm, about 57 mm, about 58 mm, about 59 mm, about 60 mm, about 61 mm, about 62 mm, about 63 mm, about 64 mm, about 65 mm, about 66 mm, about 67 mm, about 68 mm, about 69 mm, about 70 mm, about 71 mm, about 72 mm, about 73 mm, about 74 mm, about 75 mm, about 76 mm, about 77 mm, about 78 mm, about 79 mm, about 80 mm, about 81 mm, about 82 mm, about 83 mm, about 84 mm, about 85 mm, about 86 mm, about 87 mm, about 88 mm, about 89 mm, about 90 mm, about 91 mm, about 92 mm, about 93 mm, about 94 mm, about 95 mm, about 96 mm, about 97 mm, about 98 mm, about 99 mm, about 100 mm, about 101 mm, about 102 mm, about 103 mm, about 104 mm, about 105 mm, about 106 mm, about 107 mm, about 108 mm, about 109 mm, about 110 mm, about 111 mm, about 112 mm, about 113 mm, about 114 mm, about 115 mm, about 116 mm, about 117 mm, about 118 mm, about 119 mm, about 120 mm, or between any two of those values.

In various exemplary configurations, displacement A22 may be at least about 0 mm, at least about 0.5 mm, at least about 1 mm, at least about 1.5 mm, at least about 2 mm, at least about 2.5 mm, at least about 3 mm, at least about 3.5 mm, at least about 4 mm, at least about 4.5 mm, at least about 5 mm, at least about 5.5 mm, at least about 6 mm, or at least about 6.5 mm. Additionally or alternatively, displacement A22 may be up to about 21.8 mm, up to about 21.5 mm, up to about 21 mm, up to about 20.5 mm, up to about 20 mm, up to about 19.5 mm, up to about 19 mm, up to about 18.5 mm, up to about 18 mm, up to about 17.5 mm, up to about 17 mm, up to about 16.5 mm, up to about 16 mm, up to about 15.5 mm, up to about 15 mm, up to about 14.5 mm, up to about 14 mm, up to about 13.5 mm, up to about 13 mm, up to about 12.5 mm, up to about 12 mm, up to about 11.5 mm, up to about 11 mm, up to about 10.5 mm, up to about 10 mm, up to about 9.5 mm, up to about 9 mm, up to about 8.5 mm, up to about 8 mm, up to about 7.5 mm, or up to about 7 mm. Additionally, or alternatively, displacement A22 may be about 0 mm, about 0.2 mm, about 0.4 mm, about 0.6 mm, about 0.8 mm, about 1 mm, about 1.2 mm, about 1.4 mm, about 1.6 mm, about 1.8 mm, about 2 mm, about 2.2 mm, about 2.4 mm, about 2.6 mm, about 2.8 mm, about 3 mm, about 3.2 mm, about 3.4 mm, about 3.6 mm, about 3.8 mm, about 4 mm, about 4.2 mm, about 4.4 mm, about 4.6 mm, about 4.8 mm, about 5 mm, about 5.2 mm, about 5.4 mm, about 5.6 mm, about 5.8 mm, about 6 mm, about 6.2 mm, about 6.4 mm, about 6.6 mm, about 6.8 mm, about 7 mm, about 7.2 mm, about 7.4 mm, about 7.6 mm, about 7.8 mm, about 8 mm, about 8.2 mm, about 8.4, about 8.6 mm, about 8.8 mm, about 9 mm, about 9.2 mm, about 9.4 mm, about 9.6 mm, about 9.8 mm, about 10 mm, about 10.2 mm, about 10.4 mm, about 10.6 mm, about 10.8 mm, about 11 mm, about 11.2 mm, about 11.4 mm, about 11.6 mm, about 11.8 mm, about 12 mm, about 12.2 mm, about 12.4 mm, about 12.6 mm, about 12.8 mm, about 13 mm, about 13.2 mm, about 13.4 mm, about 13.6 mm, about 13.8 mm, about 14 mm, about 14.2 mm, about 14.4 mm, about 14.6 mm, about 14.8 mm, about 15 mm, about 15.2 mm, about 15.4 mm, about 15.6 mm, about 15.8 mm, about 16 mm, about 16.2 mm, about 16.4 mm, about 16.6 mm, about 16.8 mm, about 17 mm, about 17.2 mm, about 17.4 mm, about 17.6 mm, about 17.8 mm, about 18 mm, about 18.2 mm, about 18.4 mm, about 18.6 mm, about 18.8 mm, about 19 mm, about 19.2 mm, about 19.4 mm, about 19.6 mm, about 19.8 mm, about 20 mm, about 20.2 mm, about 20.4 mm, about 20.6 mm, about 20.8 mm, about 21 mm, about 21.2 mm, about 21.4 mm, about 21.6 mm, about 21.8 mm, or between any two of those values.

In various exemplary configurations, displacement A6 may be at least about 0 degrees, at least about 2 degrees, at least about 4 degrees, at least about 6 degrees, at least about 8 degrees, or at least about 10 degrees. Additionally or alternatively, displacement A6 may be up about 40 degrees, up to about 35 degrees, up to about 30 degrees, up to about 25 degrees, up to about 20 degrees, up to about 15 degrees, or up to about 10 degrees. Additionally or alternatively, displacement A6 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, or between any two of those values.

In various exemplary configurations, displacement A7 may be at least about 0 degrees, at least about 5 degrees, at least about 10 degrees, at least about 15 degrees, at least about 20 degrees, at least about 25 degrees, at least about 30 degrees, at least about degrees, at least about 40 degrees, or at least about 45 degrees. Additionally or alternatively, displacement A7 may be up about 90 degrees, up to about 85 degrees, up to about 80 degrees, up to about 75 degrees, up to about 70 degrees, up to about 65 degrees, up to about 60 degrees, up to about 55 degrees, up to about 50 degrees, or up to about 45 degrees. Additionally or alternatively, displacement A7 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, about 41 degrees, about 42 degrees, about 43 degrees, about 44 degrees, about 45 degrees, about 46 degrees, about 47 degrees, about 48 degrees, about 49 degrees, about 50 degrees, about 51 degrees, about 52 degrees, about 53 degrees, about 54 degrees, about 55 degrees, about 56 degrees, about 57 degrees, about 58 degrees, about 59 degrees, about 60 degrees, about 61 degrees, about 62 degrees, about 63 degrees, about 64 degrees, about 65 degrees, about 66 degrees, about 67 degrees, about 68 degrees, about 69 degrees, about 70 degrees, about 71 degrees, about 72 degrees, about 73 degrees, about 74 degrees, about 75 degrees, about 76 degrees, about 77 degrees, about 78 degrees, about 79 degrees, about 80 degrees, about 81 degrees, about 82 degrees, about 83 degrees, about 84 degrees, about 85 degrees, about 86 degrees, about 87 degrees, about 88 degrees, about 89 degrees, about 90 degrees, or between any two of those values.

In various exemplary configurations, displacement A8 may be at least about 0 degrees, at least about 2 degrees, at least about 4 degrees, at least about 6 degrees, at least about 8 degrees, at least about 10 degrees, at least about 12 degrees, at least about 14 degrees, at least about 16 degrees, at least about 18 degrees, at least about 20 degrees. Additionally or alternatively, displacement A8 may be up about 45 degrees, up to about 40 degrees, up to about 35 degrees, up to about 30 degrees, or up to about 25 degrees. Additionally or alternatively, displacement A8 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, about 41 degrees, about 42 degrees, about 43 degrees, about 44 degrees, about 45 degrees, or between any two of those values.

In various exemplary configurations, displacement A9 may be at least about 0 degrees, at least about 2 degrees, at least about 4 degrees, at least about 6 degrees, at least about 8 degrees, or at least about 10 degrees. Additionally or alternatively, displacement A9 may be up about 40 degrees, up to about 35 degrees, up to about 30 degrees, up to about 25 degrees, up to about 20 degrees, up to about 15 degrees, or up to about 10 degrees. Additionally or alternatively, displacement A9 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, or between any two of those values.

In various exemplary configurations, displacement A10 may be at least about 0 degrees, at least about 2 degrees, at least about 4 degrees, at least about 6 degrees, at least about 8 degrees, at least about 10 degrees, at least about 12 degrees, at least about 14 degrees, at least about 16 degrees, at least about 18 degrees, at least about 20 degrees. Additionally or alternatively, displacement A10 may be up about 45 degrees, up to about 40 degrees, up to about 35 degrees, up to about 30 degrees, or up to about 25 degrees. Additionally or alternatively, displacement A10 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, about 41 degrees, about 42 degrees, about 43 degrees, about 44 degrees, about 45 degrees, or between any two of those values.

In various exemplary configurations, displacement A12 may be at least about 0 degrees, at least about 2 degrees, at least about 4 degrees, at least about 6 degrees, at least about 8 degrees, or at least about 10 degrees. Additionally or alternatively, displacement A12 may be up about 40 degrees, up to about 35 degrees, up to about 30 degrees, up to about 25 degrees, up to about 20 degrees, up to about 15 degrees, or up to about 10 degrees. Additionally or alternatively, displacement A12 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, or between any two of those values.

In various exemplary configurations, displacement A24 may be at least about 0 degrees, at least about 5 degrees, at least about 10 degrees, at least about 15 degrees, at least about 20 degrees, at least about 25 degrees, at least about 30 degrees, at least about degrees, at least about 40 degrees, at least about 45 degrees, at least about 50 degrees, or at least about 55 degrees. Additionally or alternatively, displacement A24 may be up about 90 degrees, up to about 85 degrees, up to about 80 degrees, up to about 75 degrees, up to about 70 degrees, up to about 65 degrees, up to about 60 degrees, or up to about 55 degrees. Additionally or alternatively, displacement A24 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, about 41 degrees, about 42 degrees, about 43 degrees, about 44 degrees, about 45 degrees, about 46 degrees, about 47 degrees, about 48 degrees, about 49 degrees, about 50 degrees, about 51 degrees, about 52 degrees, about 53 degrees, about 54 degrees, about 55 degrees, about 56 degrees, about 57 degrees, about 58 degrees, about 59 degrees, about 60 degrees, about 61 degrees, about 62 degrees, about 63 degrees, about 64 degrees, about 65 degrees, about 66 degrees, about 67 degrees, about 68 degrees, about 69 degrees, about 70 degrees, about 71 degrees, about 72 degrees, about 73 degrees, about 74 degrees, about 75 degrees, about 76 degrees, about 77 degrees, about 78 degrees, about 79 degrees, about 80 degrees, about 81 degrees, about 82 degrees, about 83 degrees, about 84 degrees, about 85 degrees, about 86 degrees, about 87 degrees, about 88 degrees, about 89 degrees, about 90 degrees, or between any two of those values.

In various exemplary configurations, displacement A25 may be at least about 0 degrees, at least about 2 degrees, at least about 4 degrees, at least about 6 degrees, at least about 8 degrees, or at least about 10 degrees. Additionally or alternatively, displacement A25 may be up about 40 degrees, up to about 35 degrees, up to about 30 degrees, up to about 25 degrees, up to about 20 degrees, up to about 15 degrees, or up to about 10 degrees. Additionally or alternatively, displacement A25 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, or between any two of those values.

In various exemplary configurations, inward displacement A26 may be at least about 0 degrees, at least about 2 degrees, at least about 4 degrees, at least about 6 degrees, at least about 8 degrees, or at least about 10 degrees. Additionally or alternatively, inward displacement A26 may be up about 40 degrees, up to about 35 degrees, up to about 30 degrees, up to about 25 degrees, up to about 20 degrees, up to about 15 degrees, or up to about 10 degrees. Additionally or alternatively, inward displacement A26 may be about 0 degrees, about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, about 24 degrees, about 25 degrees, about 26 degrees, about 27 degrees, about 28 degrees, about 29 degrees, about 30 degrees, about 31 degrees, about 32 degrees, about 33 degrees, about 34 degrees, about 35 degrees, about 36 degrees, about 37 degrees, about 38 degrees, about 39 degrees, about 40 degrees, or between any two of those values.

FIGS. 22-34 show an alternative form of the arm assembly. Unless described below as being different, the features, functionality, and options are the same as outlined herein for the arm assembly 100. Like reference numerals indicate like parts with the addition of 1000.

Figure 22:
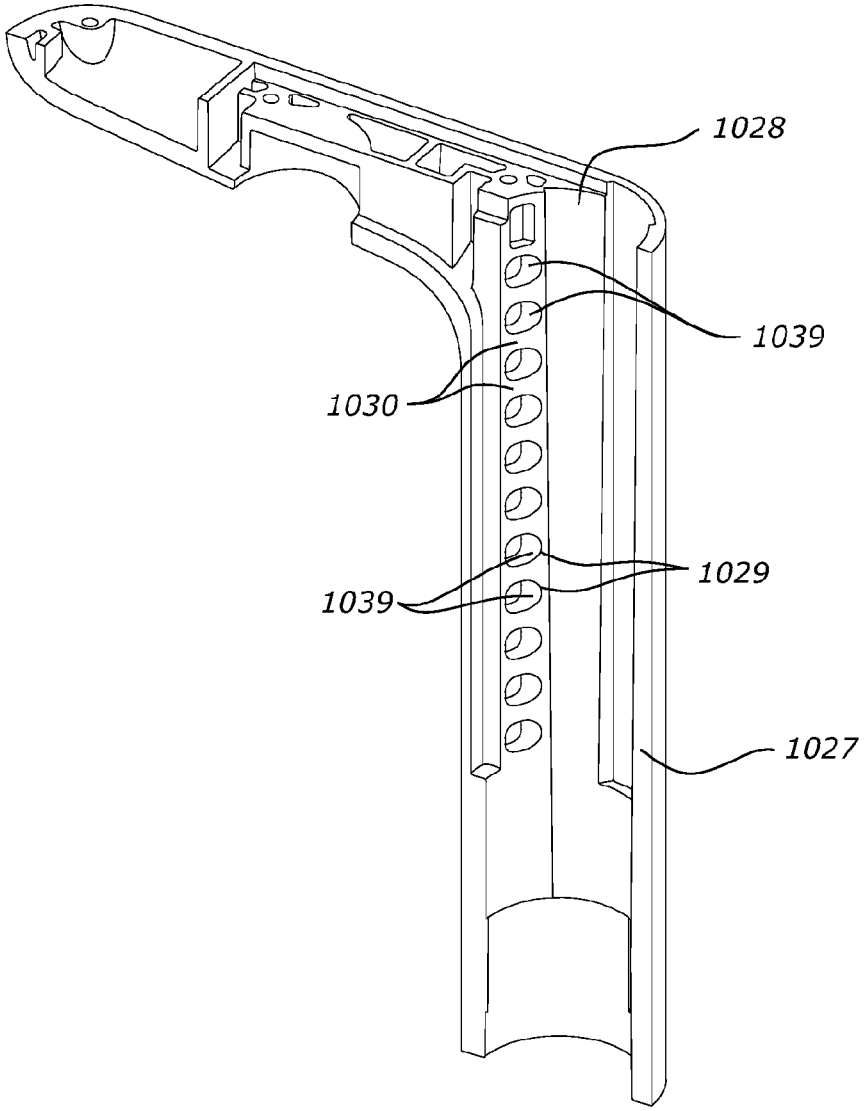
FIG. 22 shows a cross-sectional perspective view of the outer housing of an alternative form of the arm assembly.

It will be understood that any one or more of the features of this arm assembly 1100 can be used in combination with any one or more of the features of the arm assembly 100. As shown in FIG. 22, the outer housing 1027 comprises a plurality of recesses 1029 disposed within an interior 1028 of the outer housing 1027 and provided along a length thereof. The recesses 1029 also have raised surfaces 1030 therebetween that are flush with the interior 1028 of the outer housing 1027. The outer housing 1027 may comprise a single column of recesses 1029 and raised surfaces 1030, or may have two spaced-apart columns of recesses 1029 and raised surfaces 1030.

The recesses 1029 are integrally formed with the outer housing 1027. No liner component is provided in this embodiment.

The recesses 1029 are shown as having a rounded shape profile 1039.

Figure 23:
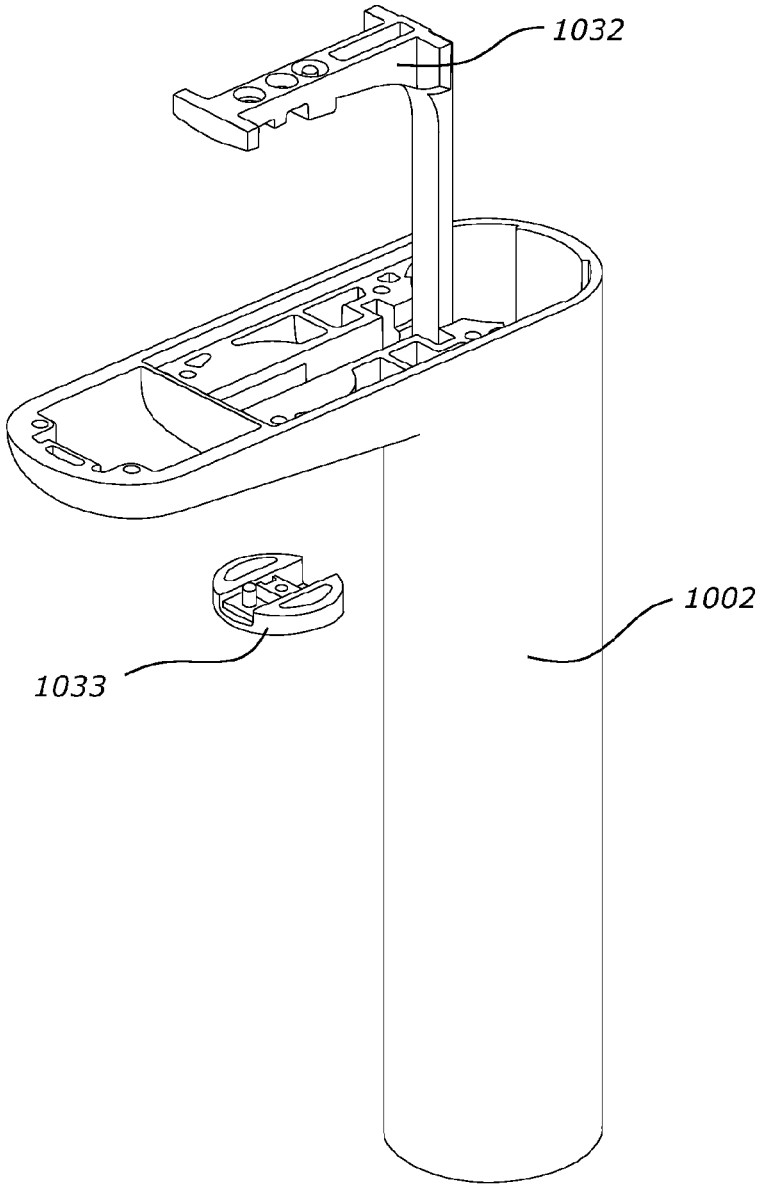
FIG. 23 shows an exploded perspective view of the outer housing, actuator, and release member of the alternative form of the arm assembly.

As shown in FIG. 23, the actuator 1033 is formed as a separate component that is connected to the release member 1032. This enables the release member 1032 to be inserted into the first member 1002 from above the first member, and the actuator 1033 to be inserted into the first member 1002 from beneath the first member.

The actuator 1033 can be connected to the release member 1032 via any suitable connection feature(s). For example, the actuator 1033 and the release member 1032 may comprise complementary engagement features such as snaps, clips, a protrusion and recess, or the like. Additionally, or alternatively, the actuator 1033 and the release member 1032 may be connected to each other via a suitable fastener 1034 such as that shown in FIG. 26 for example.

Figure 24:
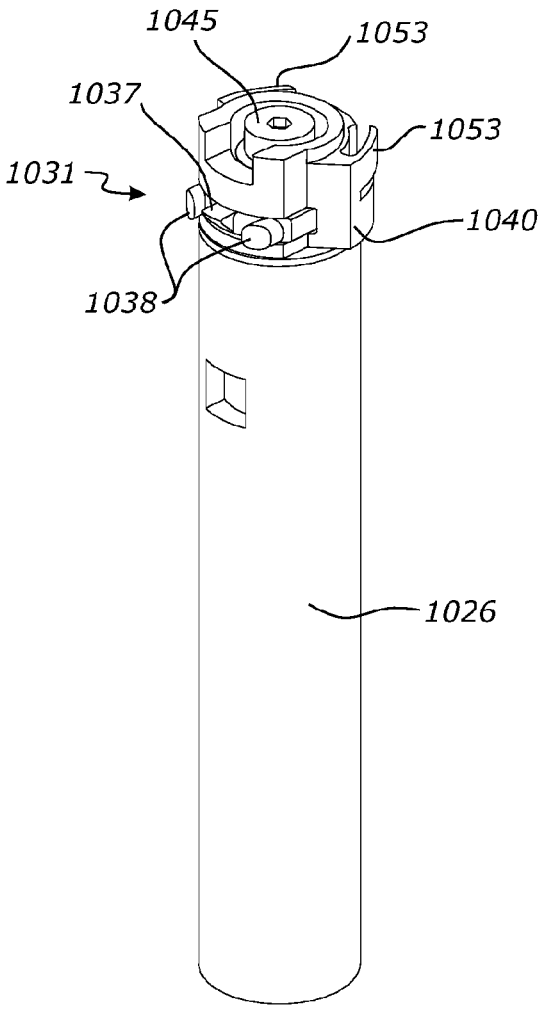
FIG. 24 shows a perspective view of the lock housing of the alternative form of the arm assembly with the locking member in its engaged position.
Figure 25:
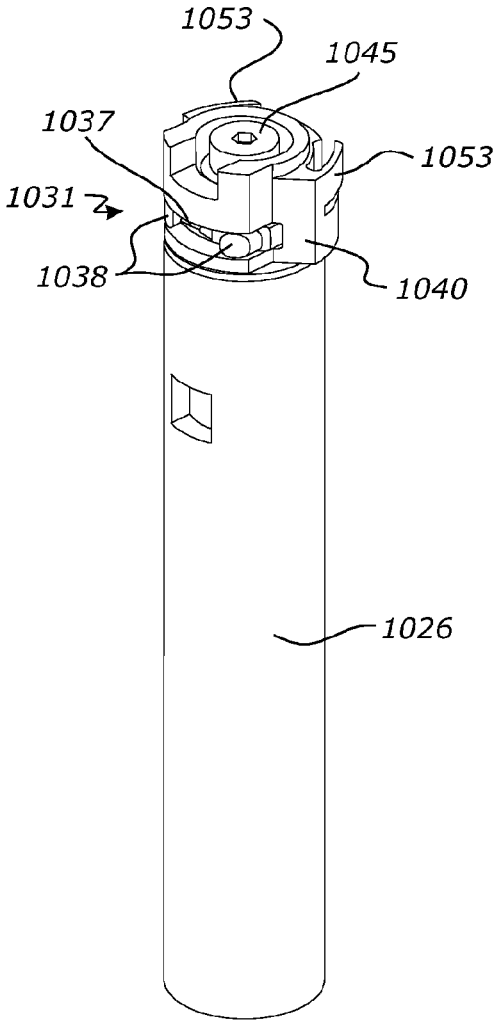
FIG. 25 shows a perspective view of the lock housing of the alternative form of the arm assembly with the locking member in its disengaged position.

As shown in FIGS. 24 and 25, the locking member 1031 has a rounded shape protrusion 1038 that corresponds to the general profile 1039 of the recesses 1029 of the outer housing 1027.

When there are two spaced-apart columns of recesses 1029 and raised surfaces 1030, the locking member will have two spaced apart protrusions 1038.

Figure 26:
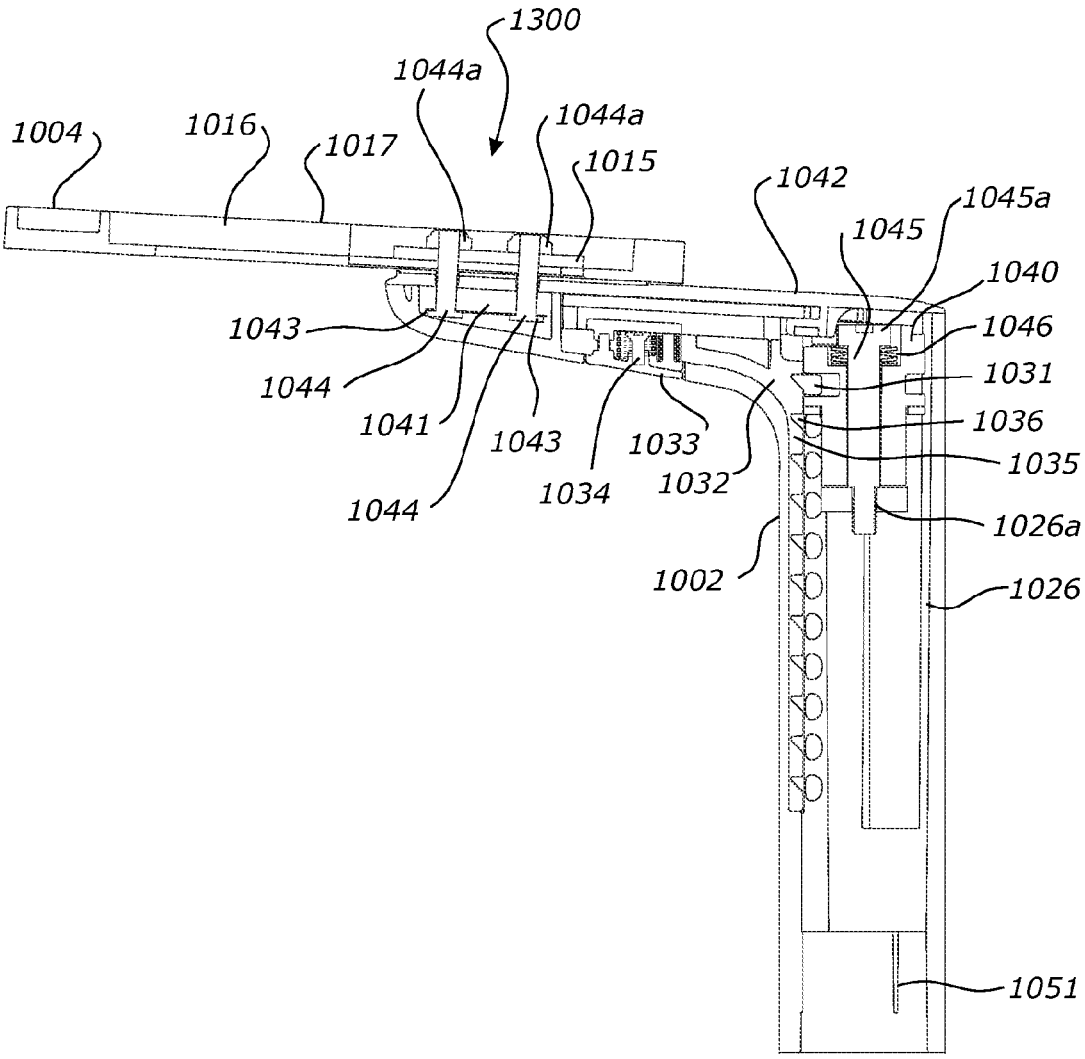
FIG. 26 shows a cross-sectional side view of the alternative form of the arm assembly with the release member in its first position.

As shown in FIG. 26, the first frictional arrangement 1300 comprises a biasing device to bias the slide plate 1016 between the upper angle stop 1015 and the top cap 1042 to provide the first frictional force.

This biasing device comprises a spring member 1041 which acts against an upper surface 1042 of the first member 2 and against heads 1043 of the fasteners 1044. The heads 1043 are disposed underneath the spring member 1041. Inherently, this creates a reaction force which causes the upper angle stop 1015 to push, or 'clamp' the slide plate 1016 down onto the upper surface 1042 of the first member 1002, thereby providing friction to both translational sliding and angular adjustment of the armrest 1004 relative to the first member 1002.

In some embodiments, an adjuster is provided to allow adjustment of the first frictional force provided by the first frictional arrangement 1300. For instance, FIG. 26 shows fasteners 1044 that are operatively coupled to the first frictional arrangement 1300 by being threaded through threaded apertures in the upper angle stop 1015. The fasteners 1044 of the arm assembly 1100 are inverted compared to the fasters 44 of the arm assembly 100.

The extent to which the fasteners 1044 are threaded through the apertures in the upper angle stop 1015 will adjust the magnitude of the biasing force of the spring member 1041. The desired position of the fasteners 1044 relative to the upper angle stop 1015 can be locked via nuts 1044*a*.

The fasteners 1044 can be of any suitable type, such as studs, bolts, or screws for example.

Figure 27:
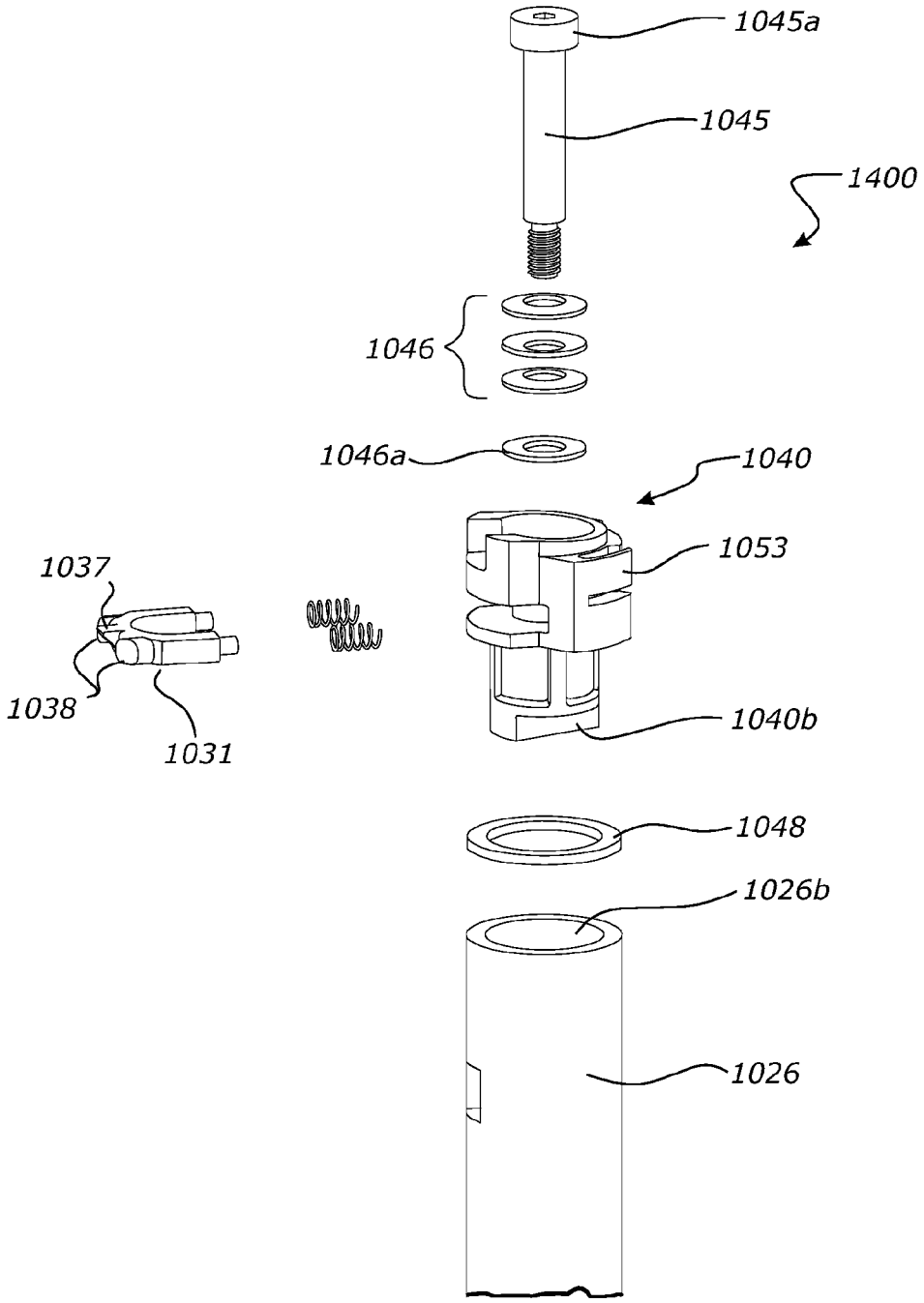
FIG. 27 shows an exploded perspective view of the second frictional arrangement of the alternative form of the arm assembly.
Figure 28:
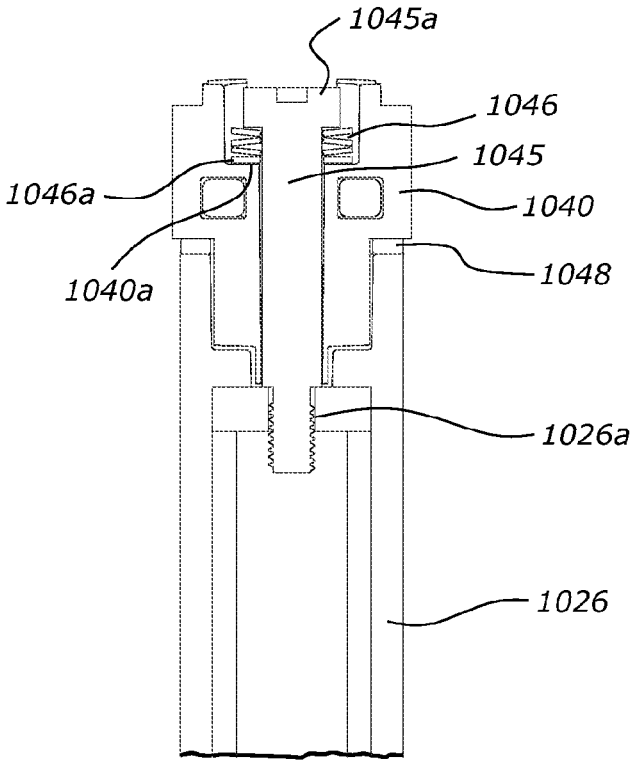
FIG. 28 shows a cross-sectional side view of the second frictional arrangement of the alternative form of the arm assembly.
Figure 29:
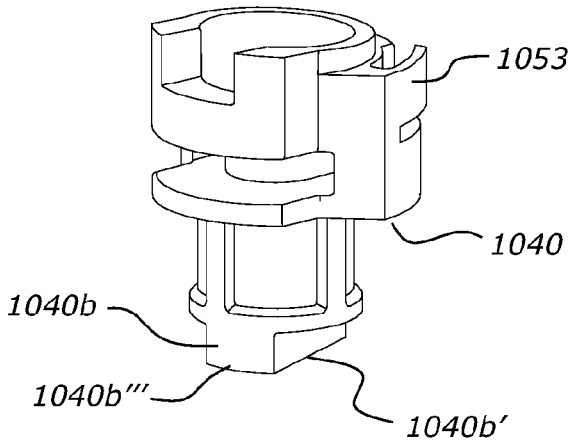
FIG. 29 shows a perspective view of the lock housing of the alternative form of the arm assembly showing a boss under the lock housing.
Figure 30:
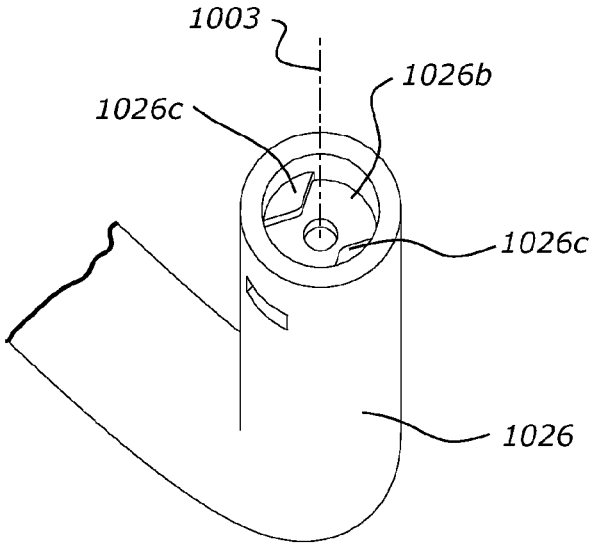
FIG. 30 shows an upper end of the arm post of the alternative form of the arm assembly showing engagement surfaces for engaging with the boss.

FIGS. 27 and 28 show the second frictional arrangement 1400 that comprises a biasing device to bias a portion of the first member 1002 into contact with the post 1001 to provide the second frictional force. This portion of the first member 1002 is the lock housing 1040.

The biasing device of the second frictional arrangement 1400 comprises a spring arrangement 1046 which, in the form shown, is provided by a plurality of washers which may be Belleville washers or disc spring washers. A flat washer 1046*a* is provided between the base of the spring arrangement 1046 and a surface 1040*a* of the lock housing 1040.

A fastener 1045 is threaded into a threaded aperture 1026*a* in the inner post member 1026 and sandwiches the spring arrangement 1046 between a head 1045*a* of the fastener and a surface 1040*a* of the lock housing 1400.

The fastener 1045 can be of any suitable type, such as a stud, a bolt, or a screw for example. In the configuration shown, the fastener 1045 is a shoulder bolt.

The spring arrangement 1046 acts against the head 1045*a* of the fastener. Inherently, this creates a reaction force which causes the lock housing 1040 to push, or 'clamp' down onto a bearing member 1048 atop which the lock housing 1040 is mounted. This bearing member 1048 is rotatably mounted to the inner post member 1026 and thus this arrangement thereby provides friction to angular adjustment of the lock housing 1040, and thus the outer housing 1027, relative to the inner post member 1026, and thus post 1001.

The extent to which the fastener 1045 is screwed into the threaded aperture 1026*a* and thereby the height of the head 1045*a* of the fastener 1045 determines the magnitude of the biasing force of the spring arrangement 1046, and the resulting reactionary force that causes the lock housing 1040 to push, or 'clamp' down onto a bearing member 1048 atop which the lock housing 1040 is mounted. As a result, this fastener 1045 generally governs the amount of second frictional force provided by the second frictional arrangement 1400. The compression applied by the fastener 1045 may be set during assembly of the arm assembly 1100.

The surface 1040*a* is provided at the base of a recess in the top of the lock housing 1040. The head 1045*a* of the fastener, the spring arrangement 1046, and the washer 1046*a* are located in that recess in use.

With reference to FIGS. 29-31C, in this form of the arm assembly 1001 the lower angle stop 1047 is provided by a portion of the lock housing 1040 that is engageable with complementary engagement surfaces on the inner post member 1026 to define the first angular movement limits.

The lower end of the lock housing 1040 comprises a boss 1040*b*. The boss has a shape that is elongate in a direction transverse to the first substantially upright axis 1003. In the form shown, the boss 1040*b* has a substantially rectangular shape with parallel elongate side walls comprising an outer wall 1040*b*' and an inner wall 1060*b*", and rounded ends 1040*b*". Alternative shapes could be used.

The engagement surfaces are provided by opposed engagement members 1026*c* that project toward the first substantially upright axis 1003 from an inner wall of a recess 1026*b* in an upper end of the inner post member 1026. In the form shown, the engagement members 1026*c* are wedge-shaped. Alternative shapes could be used. The engagement members 1026*c* define a forward outer engagement surface 1026*d*', a rear outer engagement surface 1026*d*", a forward inner engagement surface 1026*e*', and a rear inner engagement surface 1026*e*".

The lower angle stop 1047 is configured to define the first angular movement limits and thus define the maximum outward angular adjustment A6 of the first member 1002 relative to the post 1001 and the maximum inward angular adjustment A7 of the first member 1002 relative to the post 1001, as described above in relation to FIG. 4.

Figure 31A:
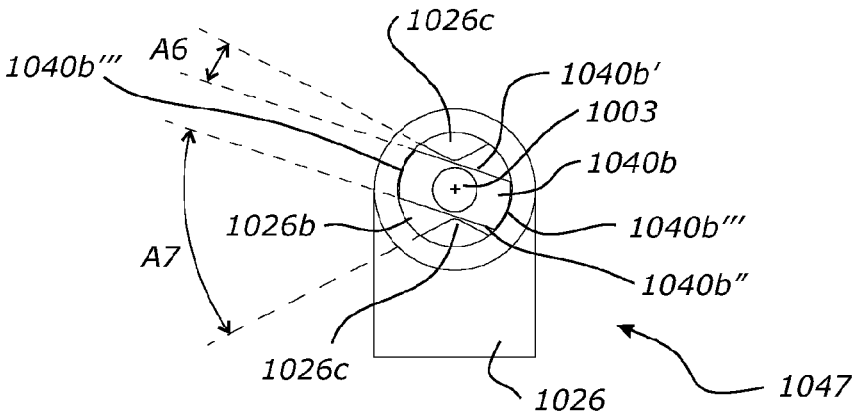
FIG. 31A shows the boss and the engagement features in a neutral position of the first member relative to the arm post.
Figure 31B:
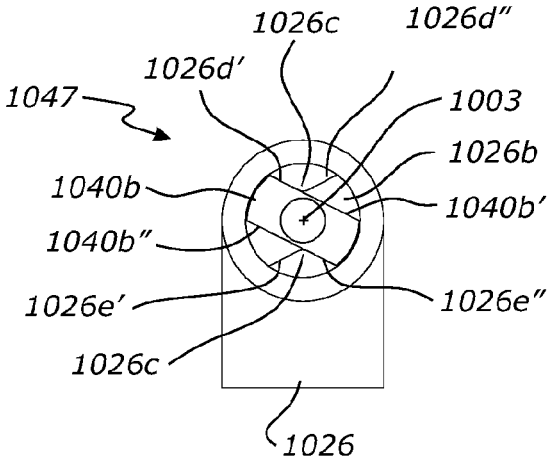
FIG. 31B shows the boss and the engagement surfaces in the maximum outward angular adjustment position of the first member relative to the arm post.
Figure 31C:
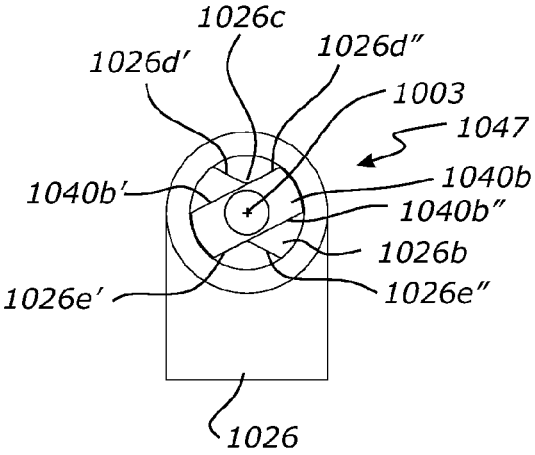
FIG. 31C shows the boss and the engagement surfaces in the maximum inward angular adjustment position of the first member relative to the arm post.

As shown in FIG. 31B, contact between the outer wall 1040*b*' of the boss 1040 and the forward outer engagement surface 1026*d*' and/or contact between the inner wall 1040*b*" of the boss 1040 and the rear inner engagement surface 1026*e*" define the maximum outward angular adjustment A6 of the first member 1002 relative to the post 1001. As shown in FIG. 31C, contact between the inner wall 1040*b*" of the boss 1040 and the forward inner engagement surface 1026*e*' and/or contact between the outer wall 1040*b*' of the boss 1040 and the rear outer engagement surface 1026*d*" define the maximum outward angular adjustment A6 of the first member 1002 relative to the post 1001.

Figure 32:
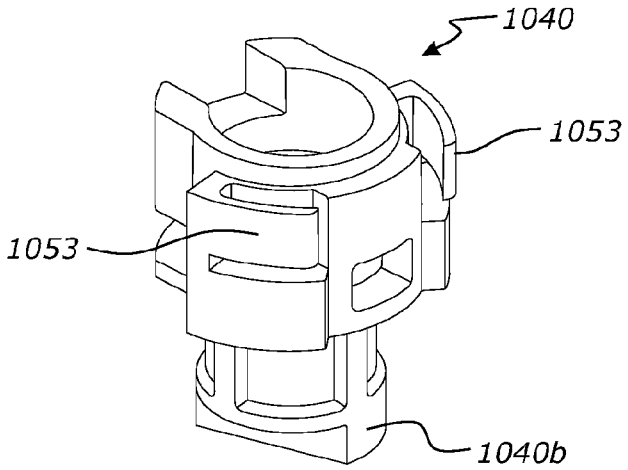
FIG. 32 shows a perspective view of the lock housing of the alternative form of the arm assembly and its biasing features.
Figure 33:
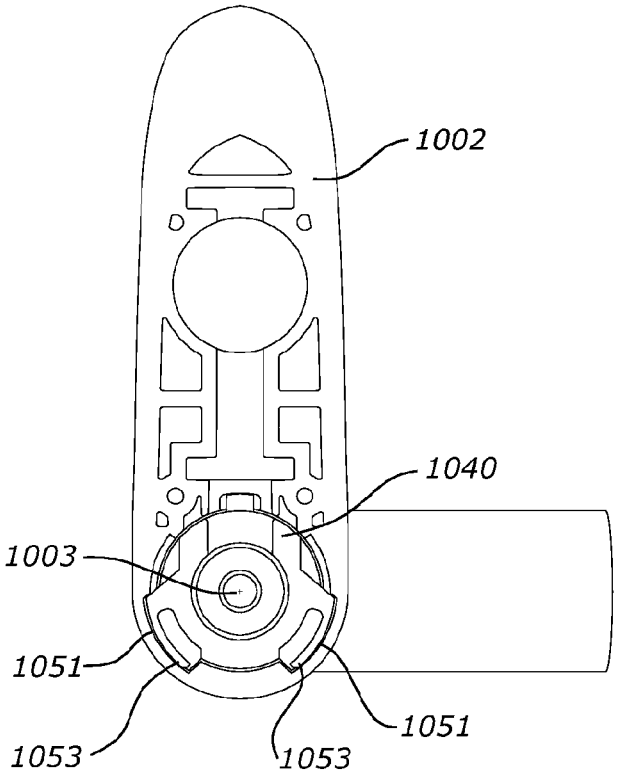
FIG. 33 shows a top view of the biasing features of the lock housing of the alternative form of the arm assembly engaging with the arm post.

FIGS. 32 and 33 show an alternative configuration for the at least one first biasing member 1053 of the damping arrangement that is configured to inhibit lateral movement of the first member 1002 relative to the post 1001.

In this configuration, the at least one first biasing member 1053 that extends between the lock housing 1040 and an internal wall 1051 of the outer housing 1027 is integrally formed with the lock housing 1040. That is, an integral portion of the lock housing 1040 provides the at least one first biasing member 1053.

The at least one first biasing member 1053 comprises a resilient cantilevered flange of the lock housing 1040 that is configured to contact the internal wall 1051 of the outer housing 1027. The flange 1053 has a convex outer surface to engage with the concave internal wall 1051. The flange 1053 is shaped and configured so that it needs to be compressed or flexed to fit within the internal wall 1051. This compression or flexing acts to provide a biasing force between the first member 1002 and the post 1001.

In the configuration shown, there are two circumferentially spaced biasing members 1053 on the lock housing 1040. In an alternative configuration, there could be one, three, or more of the biasing members 1053.

Figure 34:
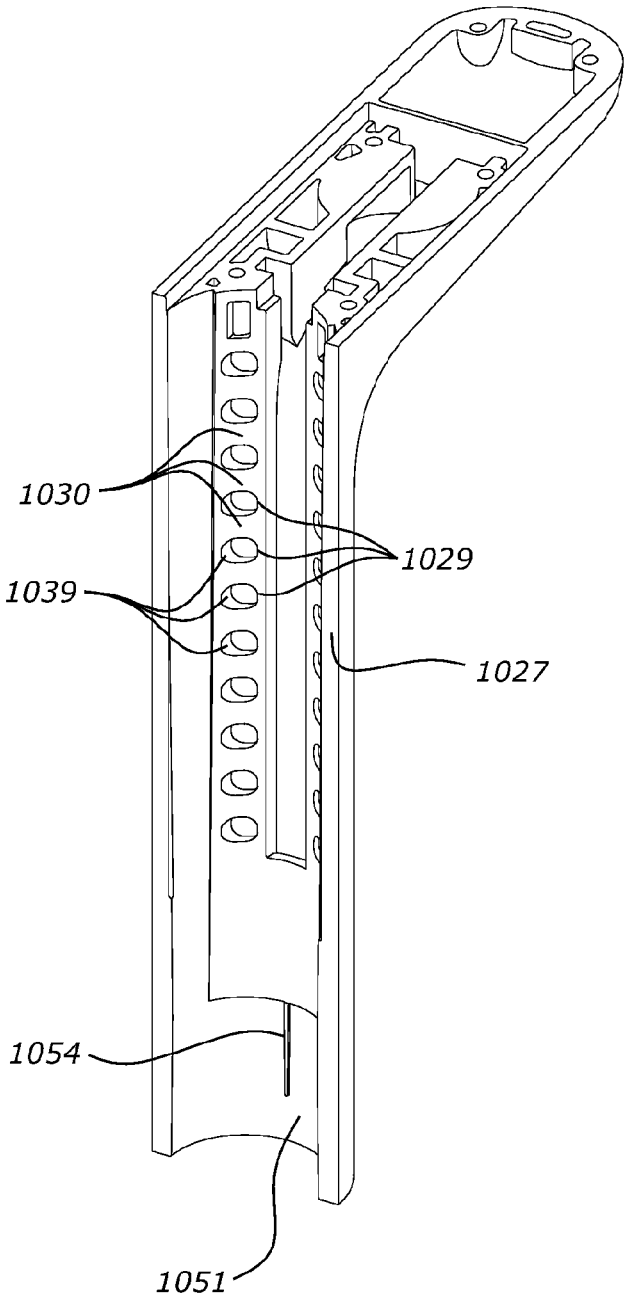
FIG. 34 shows a cross-sectional perspective view of the outer housing of the alternative form of the arm assembly, showing one of the ribs adjacent the bottom of the housing.

With reference to FIG. 34, rather than having at least one second biasing member, the damping arrangement comprises at least one rib 1054 extending between the inner post member 1026 and the internal wall 1051 of the outer housing 1027. The at least one first biasing member 1053 and the at least one rib 1054 are spaced apart in a vertical direction.

In the form shown, the at least one rib 1054 is integrally formed with the outer housing 1027.

The rib 1054 is elongate in a longitudinal direction of the arm post that corresponds to the first substantially upright axis 1003.

Although only one rib 1054 is shown in FIG. 34, there may be one, two, three or more circumferentially spaced ribs around the internal wall 1051 of the outer housing 1027. The rib(s) is/are provided with a tight tolerance to the inner post member 1026. In some configurations, there may be three or more ribs to assist with keeping the axes of the post and the outer housing aligned.

In an alternative configuration, the one or more ribs 1054 may be provided on an outer surface of the inner post member 1026 to contact the internal wall 1051 of the outer housing 1027.

The invention claimed is:

1. An arm assembly for a chair, the arm assembly comprising:

a post for mounting to the chair, the post comprising a substantially upright inner post member;

a first member that is operatively connected to the post, wherein the first member is angularly adjustable relative to the post about a first substantially upright axis between first angular movement limits, the arm assembly comprising non-discrete angular adjustment positions of the first member relative to the post between the first angular movement limits; and an armrest that is operatively connected to the first member to translationally slide generally forward and rearward relative to the first member between first translational movement limits, the arm assembly comprising non-discrete translational adjustment positions of the armrest relative to the first member between the first translational movement limits, and wherein the armrest is angularly adjustable relative to the first member about a second substantially upright axis between second angular movement limits, the arm assembly comprising non-discrete angular adjustment positions of the armrest relative to the first member between the second angular movement limits, wherein the armrest comprises a slide plate comprising a slot, wherein the second substantially upright axis extends through the slot to enable the translational sliding and the angular adjustment of the armrest relative to the first member.

2. The arm assembly of claim 1, wherein an inward angular adjustment of the first member relative to the post and an outward angular adjustment of a front end of the armrest relative to the first member together provide a lateral inward width adjustment of the armrest, and wherein an outward angular adjustment of the first member relative to the post and an inward angular adjustment of a front end of the armrest relative to the first member together provide a lateral outward width adjustment of the armrest.

3. The arm assembly of claim 1, wherein the outer housing is angularly adjustable relative to the inner post member about the first substantially upright axis between the first angular movement limits.

4. The arm assembly of claim 1, wherein the first member comprises an upper angle stop positioned at the second substantially upright axis.

5. The arm assembly of claim 4, wherein the slot is configured to receive the upper angle stop.

6. The arm assembly of claim 1, comprising a second frictional arrangement that is configured to provide a second frictional force that must be overcome by a user to angularly adjust the first member relative to the post.

7. The arm assembly of claim 6, wherein the second frictional arrangement comprises a biasing device to bias a portion of the first member into contact with the post to provide the second frictional force.

8. The arm assembly of claim 1, wherein a component keyed to the first member and mounted to the post comprises a lower angle stop positioned at the first substantially upright axis, wherein the lower angle stop is configured to define the first angular movement limits.

9. The arm assembly of claim 1, wherein the outer housing slidably receives the post in a telescopic arrangement such that the height of the first member is adjustable relative to the post.

10. The arm assembly of claim 1, comprising a damping arrangement between the outer housing and the inner post member, the damping arrangement configured to inhibit lateral movement of the first member relative to the post.

11. A chair comprising two of the arm assemblies of claim 1.

12. An arm assembly for a chair, the arm assembly comprising:

a post for mounting to the chair, the post comprising a substantially upright inner post member;

a first member that is operatively connected to the post, the first member comprising an outer housing that is slidably mounted on and receives the inner post member in a telescopic arrangement, wherein the first member is angularly adjustable relative to the post about a first substantially upright axis between first angular movement limits, the arm assembly comprising non-discrete angular adjustment positions of the first member relative to the post between the first angular movement limits; and an armrest that is operatively connected to the first member to translationally slide generally forward and rearward relative to the first member between first translational movement limits, the arm assembly comprising non-discrete translational adjustment positions of the armrest relative to the first member between the first translational movement limits, and wherein the armrest is angularly adjustable relative to the first member about a second substantially upright axis between second angular movement limits, the arm assembly comprising non-discrete angular adjustment positions of the armrest relative to the first member between the second angular movement limits, wherein the armrest comprises a slide plate comprising a slot, wherein the second substantially upright axis extends through the slot to enable the translational sliding and the angular adjustment of the armrest relative to the first member, wherein the first member comprises an upper angle stop positioned at the second substantially upright axis, the slot being configured to receive the upper angle stop, and wherein the arm assembly comprises a first frictional arrangement associated with the upper angle stop, wherein the first frictional arrangement is configured to provide a first frictional force that must be overcome by a user to translationally slide and angularly adjust the armrest relative to the first member.

13. The arm assembly of claim 12, wherein the first frictional arrangement comprises a biasing device to bias the slide plate into contact with the upper angle stop to provide the first frictional force.

14. An arm assembly for a chair, the arm assembly comprising:

a post for mounting to the chair, the post comprising a substantially upright inner post member;

a first member that is operatively connected to the post, the first member comprising an outer housing that is slidably mounted on and receives the inner post member in a telescopic arrangement, wherein the first member is angularly adjustable relative to the post about a first substantially upright axis between first angular movement limits, the arm assembly comprising non-discrete angular adjustment positions of the first member relative to the post between the first angular movement limits; and an armrest that is operatively connected to the first member to translationally slide generally forward and rearward relative to the first member between first translational movement limits, the arm assembly comprising non-discrete translational adjustment positions of the armrest relative to the first member between the first translational movement limits, and wherein the armrest is angularly adjustable relative to the first member about a second substantially upright axis between second angular movement limits, the arm assembly comprising non-discrete angular adjustment positions of the armrest relative to the first member between the second angular movement limits, wherein the armrest comprises a slide plate comprising a slot, wherein the second substantially upright axis extends through the slot to enable the translational sliding and the angular adjustment of the armrest relative to the first member, wherein the first member comprises an upper angle stop positioned at the second substantially upright axis, the slot being configured to receive the upper angle stop, and wherein a front edge and a rear edge of the slot and a front edge and a rear edge of the upper angle stop are configured to define the first translational movement limits, such that the armrest can translationally slide in a generally forward direction relative to the first member until the rear edge of the slot contacts the rear edge of the upper angle stop and such that that the armrest can translationally slide in a generally rearward direction relative to the first member until the front edge of the slot contacts the front edge of the upper angle stop.

15. The arm assembly of claim 14, wherein a rear portion of a path of the slot is non-linear such that the armrest translationally sliding in a generally forward direction relative to the first member from the rearmost translational position causes an outward lateral movement of the armrest relative to the first member, and the armrest translationally sliding in a generally rearward direction relative to the first member toward the rearmost translational position causes an inward lateral movement of the armrest relative to the first member.

16. An arm assembly for a chair, the arm assembly comprising:

a post for mounting to the chair, the post comprising a substantially upright inner post member;

a first member that is operatively connected to the post, the first member comprising an outer housing that is slidably mounted on and receives the inner post member in a telescopic arrangement, wherein the first member is angularly adjustable relative to the post about a first substantially upright axis between first angular movement limits, the arm assembly comprising non-discrete angular adjustment positions of the first member relative to the post between the first angular movement limits; and an armrest that is operatively connected to the first member to translationally slide generally forward and rearward relative to the first member between first translational movement limits, the arm assembly comprising non-discrete translational adjustment positions of the armrest relative to the first member between the first translational movement limits, and wherein the armrest is angularly adjustable relative to the first member about a second substantially upright axis between second angular movement limits, the arm assembly comprising non-discrete angular adjustment positions of the armrest relative to the first member between the second angular movement limits, wherein the armrest comprises a slide plate comprising a slot, wherein the second substantially upright axis extends through the slot to enable the translational sliding and the angular adjustment of the armrest relative to the first member, wherein the first member comprises an upper angle stop positioned at the second substantially upright axis, the slot being configured to receive the upper angle stop, and wherein the slot is configured such that the armrest moves laterally when being moved generally forwardly and rearwardly over at least part of the movement of the armrest.

17. An arm assembly for a chair, the arm assembly comprising:

a post for mounting to the chair, the post comprising a substantially upright inner post member;

a first member that is operatively connected to the post, the first member comprising an outer housing that is slidably mounted on and receives the inner post member in a telescopic arrangement, wherein the first member is angularly adjustable relative to the post about a first substantially upright axis between first angular movement limits, the arm assembly comprising non-discrete angular adjustment positions of the first member relative to the post between the first angular movement limits; and an armrest that is operatively connected to the first member to translationally slide generally forward and rearward relative to the first member between first translational movement limits, the arm assembly comprising non-discrete translational adjustment positions of the armrest relative to the first member between the first translational movement limits, and wherein the armrest is angularly adjustable relative to the first member about a second substantially upright axis between second angular movement limits, the arm assembly comprising non-discrete angular adjustment positions of the armrest relative to the first member between the second angular movement limits, wherein the armrest comprises a slide plate comprising a slot, wherein the second substantially upright axis extends through the slot to enable the translational sliding and the angular adjustment of the armrest relative to the first member, wherein the first member comprises an upper angle stop positioned at the second substantially upright axis, the slot being configured to receive the upper angle stop, and wherein a periphery of the upper angle stop and side walls of the slot are configured to define the second angular movement limits.

18. An arm assembly for a chair, the arm assembly comprising:

a post for mounting to the chair, the post comprising a substantially upright inner post member;

a first member that is operatively connected to the post, the first member comprising an outer housing that is slidably mounted on and receives the inner post member in a telescopic arrangement, wherein the first member is angularly adjustable relative to the post about a first substantially upright axis between first angular movement limits, the arm assembly comprising non-discrete angular adjustment positions of the first member relative to the post between the first angular movement limits; and an armrest that is operatively connected to the first member to translationally slide generally forward and rearward relative to the first member between first translational movement limits, the arm assembly comprising non-discrete translational adjustment positions of the armrest relative to the first member between the first translational movement limits, and wherein the armrest is angularly adjustable relative to the first member about a second substantially upright axis between second angular movement limits, the arm assembly comprising non-discrete angular adjustment positions of the armrest relative to the first member between the second angular movement limits, wherein the armrest comprises a slide plate comprising a slot, wherein the second substantially upright axis extends through the slot to enable the translational sliding and the angular adjustment of the armrest relative to the first member, wherein the outer housing slidably receives the post in a telescopic arrangement such that the height of the first member is adjustable relative to the post, and wherein:

the outer housing comprises a plurality of recesses disposed within an interior of the outer housing and provided along a length thereof;

the inner post member comprises a locking member biased to engage with one of the plurality of recesses of the outer housing to lock the position of the outer housing relative to the inner post member; and the outer housing comprises a release member in operable connection with an actuator and having a plurality of recesses with raised surfaces therebetween, wherein the release member is slidably moveable relative to the outer housing between a first position in which at least one of the recesses in the release member is aligned with at least one of the recesses of the outer housing and the locking member engages at least one of the recesses in the outer housing to inhibit telescopic movement of the outer housing relative to the inner post member, and a second position in which one or more of the raised surfaces of the release member aligns with the one or more recesses of the outer housing to remove the locking member from engagement with the recess or recesses and to provide a surface over which the locking member can slide to enable relative movement between the outer housing and the inner post member.

19. The arm assembly of claim 18, comprising a lock housing that carries the locking member, the lock housing being rotatably mounted to the inner post member and keyed to the outer housing to inhibit relative rotation between the lock housing and the outer housing such that upon an angular adjustment of the first member relative to the post, the lock housing undergoes a corresponding angular adjustment relative to the post.

20. The arm assembly of claim 19, comprising a damping arrangement between the outer housing and the inner post member, the damping arrangement configured to inhibit lateral movement of the first member relative to the post, wherein the damping arrangement comprises at least one first biasing member extending between the lock housing and an internal wall of the outer housing and at least one second biasing member extending between the inner post member and the internal wall of the outer housing, the at least one first and second biasing members being spaced apart in a vertical direction.

* * * * *